US011649661B2

(12) United States Patent
Fischer

(10) Patent No.: US 11,649,661 B2
(45) Date of Patent: May 16, 2023

(54) APPARATUS FOR BARRICADING AN OUTWARD SWINGING DOOR TO PROVIDE PHYSICAL SECURITY

(71) Applicant: Gary Fischer, Houston, TX (US)

(72) Inventor: Gary Fischer, Houston, TX (US)

( * ) Notice: Subject to any disclaimer, the term of this patent is extended or adjusted under 35 U.S.C. 154(b) by 77 days.

(21) Appl. No.: 17/158,778

(22) Filed: Jan. 26, 2021

(65) Prior Publication Data

US 2021/0388653 A1 Dec. 16, 2021

Related U.S. Application Data

(60) Provisional application No. 63/046,832, filed on Jul. 1, 2020, provisional application No. 63/038,317, filed on Jun. 12, 2020.

(51) Int. Cl.

| | |
|---|---|
| ***E05C 19/00*** | (2006.01) |
| ***E05B 15/10*** | (2006.01) |
| ***E05C 19/18*** | (2006.01) |
| *E05B 63/00* | (2006.01) |

(52) U.S. Cl.

CPC ..... *E05C 19/003* (2013.01); *E05B 15/10* (2013.01); *E05C 19/184* (2013.01); *E05B 2063/0039* (2013.01)

(58) Field of Classification Search

CPC .. E05B 2063/0039; E05B 15/10; E05C 17/46; E05C 19/003; E05C 19/18; E05C 19/184; E05C 19/188; Y10S 292/15

USPC ..... 292/259 R, 338, 339

See application file for complete search history.

(56) References Cited

U.S. PATENT DOCUMENTS

| | | | |
|---|---|---|---|
| 1,061,269 | A | 5/1913 | Coffin |
| 1,082,432 | A | 12/1913 | Mertsheimer |
| 1,808,393 | A | 6/1931 | Wecker |
| 1,944,382 | A | 1/1934 | Wecker |
| 2,553,732 | A | 5/1951 | Young |

(Continued)

FOREIGN PATENT DOCUMENTS

| | | | |
|---|---|---|---|
| DE | 202013004894 | U1 | 9/2013 |
| GB | 2030639 | A | 4/1980 |

OTHER PUBLICATIONS

Bolo Stick Door Barricade Installation Guide, retrieved on Jun. 8, 2020 from <https://bolostick.com/bolo-stick-installation-guide>.

(Continued)

*Primary Examiner* — Kristina R Fulton
*Assistant Examiner* — James E Ignaczewski
(74) *Attorney, Agent, or Firm* — Lewis & Reese, PLLC

(57) ABSTRACT

A system to barricade a door from forced entry is disclosed. The system includes an anchor insertable by a user into a receptacle mounted into a floor on the inside on the door, and a lock affixable to the door. The anchor includes an upper portion designed to connect with the lock, and a lower portion that preferably fits within the receptacle. The lock includes a stop designed to contact the outside surface of the door, and a key plate on the inside of the door. When the anchor is vertically inserted into the receptacle, the upper portion of the anchor engages the key plate of the lock affixed to the door, which in conjunction with the stop prevents the door from swinging outwards. The anchor can be removed from the receptacle when the user doesn't desire to barricade the door.

18 Claims, 16 Drawing Sheets

(56) References Cited

U.S. PATENT DOCUMENTS

| | | | | |
|---|---|---|---|---|
| 2,568,477 | A | 9/1951 | Westlund | |
| D167,938 | S | 10/1952 | Grindstad | |
| 4,050,723 | A | 9/1977 | Papadatos | |
| 4,178,026 | A | 12/1979 | Sinkhorn | |
| 4,198,088 | A | 4/1980 | Tochihara | |
| D272,041 | S | 1/1984 | Harris et al. | |
| 4,585,259 | A | 4/1986 | Vidas | |
| 5,226,201 | A | 7/1993 | Lefebvre | |
| 5,398,982 | A | 3/1995 | Watson, Jr. | |
| 5,454,143 | A | 10/1995 | Wigley | |
| 5,454,610 | A | 10/1995 | Taylor et al. | |
| 5,458,383 | A * | 10/1995 | Gunn | E05B 67/383 292/148 |
| 5,489,129 | A | 2/1996 | Shepherd | |
| 5,590,918 | A | 1/1997 | Kambalov | |
| 5,601,319 | A * | 2/1997 | Morin | E05C 17/443 292/339 |
| 5,799,367 | A | 9/1998 | Simon et al. | |
| 5,904,325 | A | 5/1999 | Hung | |
| 5,983,680 | A | 11/1999 | Del Nin | |
| 6,345,849 | B1 | 2/2002 | Yen | |
| 6,378,917 | B1 | 4/2002 | Jones | |
| 6,471,264 | B1 | 10/2002 | Ryan | |
| 6,557,912 | B1 | 5/2003 | Truong | |
| 6,629,335 | B1 | 10/2003 | Derman | |
| 6,708,625 | B1 | 3/2004 | Burke et al. | |
| 7,021,678 | B1 | 4/2006 | Raoult | |
| 7,201,408 | B2 | 4/2007 | Cennamo, Jr. | |
| 7,367,596 | B2 | 5/2008 | Leung | |
| D602,339 | S | 10/2009 | Frankel | |
| 7,651,140 | B2 * | 1/2010 | Leggio | E05B 63/0004 292/342 |
| D612,717 | S | 3/2010 | Frankel | |
| D623,499 | S | 9/2010 | Tien | |
| D656,386 | S | 3/2012 | Shen | |
| 8,690,201 | B2 | 4/2014 | Frazier | |
| 8,708,378 | B2 | 4/2014 | Frazier | |
| D717,641 | S | 11/2014 | Hugo | |
| 8,894,110 | B2 * | 11/2014 | Taylor | E05C 19/003 292/288 |
| D722,495 | S | 2/2015 | Hugo | |
| D733,520 | S | 7/2015 | Barna | |
| 9,121,203 | B2 | 9/2015 | Muramatsu et al. | |
| 9,238,926 | B2 | 1/2016 | Guerrero et al. | |
| 9,388,620 | B2 | 7/2016 | Endo | |
| 9,435,147 | B1 | 9/2016 | Giandomenico, Jr. et al. | |
| 9,518,421 | B2 | 12/2016 | Cushwa, Jr. et al. | |
| 9,534,430 | B2 | 1/2017 | Taylor et al. | |
| 9,562,377 | B2 * | 2/2017 | Attard | E05B 67/383 |
| 9,598,885 | B2 | 3/2017 | Yamamoto et al. | |
| 9,799,181 | B2 | 10/2017 | Cushwa, Jr. et al. | |
| 9,856,682 | B1 | 1/2018 | Cook | |
| 9,863,172 | B2 | 1/2018 | Burke et al. | |
| D813,642 | S | 3/2018 | Tyus | |
| 9,957,741 | B2 | 5/2018 | Taylor et al. | |
| 10,094,154 | B2 | 10/2018 | Ploskunak et al. | |
| 10,174,532 | B2 | 1/2019 | Couturier | |
| 10,214,948 | B2 | 2/2019 | Richmond | |
| 10,316,556 | B2 * | 6/2019 | Richmond | E05C 19/004 |
| D853,832 | S | 7/2019 | Cheever et al. | |
| 2008/0216524 | A1 | 9/2008 | Abdelazeem | |
| 2009/0058104 | A1 | 3/2009 | Huang | |
| 2009/0134640 | A1 | 5/2009 | Ruffino | |
| 2011/0291426 | A1 * | 12/2011 | Gibson | E05C 19/188 292/137 |
| 2014/0159384 | A1 | 6/2014 | Frazier | |
| 2014/0312634 | A1 | 10/2014 | Cushwa, Jr. et al. | |
| 2015/0076844 | A1 | 3/2015 | Taylor et al. | |
| 2016/0230431 | A1 | 8/2016 | Yonekura | |
| 2017/0211301 | A1 | 7/2017 | Richmond | |
| 2018/0371810 | A1 * | 12/2018 | Howard | E05C 1/04 |
| 2019/0003221 | A1 | 1/2019 | Taylor et al. | |
| 2019/0284853 | A1 * | 9/2019 | Geenens | E05B 45/06 |
| 2020/0063475 | A1 | 2/2020 | Seelbinder et al. | |

OTHER PUBLICATIONS

DoorJammer: Lockdown Product Information, retrieved on Jun. 8, 2020 from <https://door-jammer.com/doorjammer-lockdown/>.

DoorJammer: Portable Product Information, retrieved on Jun. 8, 2020 from <https://door-jammer.com/doorjammer-portable/>.

Fire Door Armor Product Sheet, Fire Door Solutions, retrieved on Jun. 8, 2020 from <https://firedoorarmor.com/>.

Nightlock® Lockdown 1 | Nightlock Door Security Devices, retrieved on Jun. 8, 2020 from <https://nightlock.com/door-security-devices/door-barricade/nightlock-lockdown>.

OnGuard Security Door Brace | Door Barricade | Prevents Home Invasions, Burglaries & looters | OnGARD Withstands up to 3000 Lbs of Violent Force | On Guard, retrieved on Jun. 9, 2020 from <https://www.amazon.com/Invasions-Burglars-OnGARD-Withstands-Nightlock/dp/B0044EF1GQ>.

The Anchor Product Sheet, Anchorman Inc., retrieved on Jun. 8, 2020 from <www.anchormaninc.com>.

Extended European Search Report regarding corresponding European Patent Application Serial No. 21169402.1, dated Sep. 21, 2021.

* cited by examiner

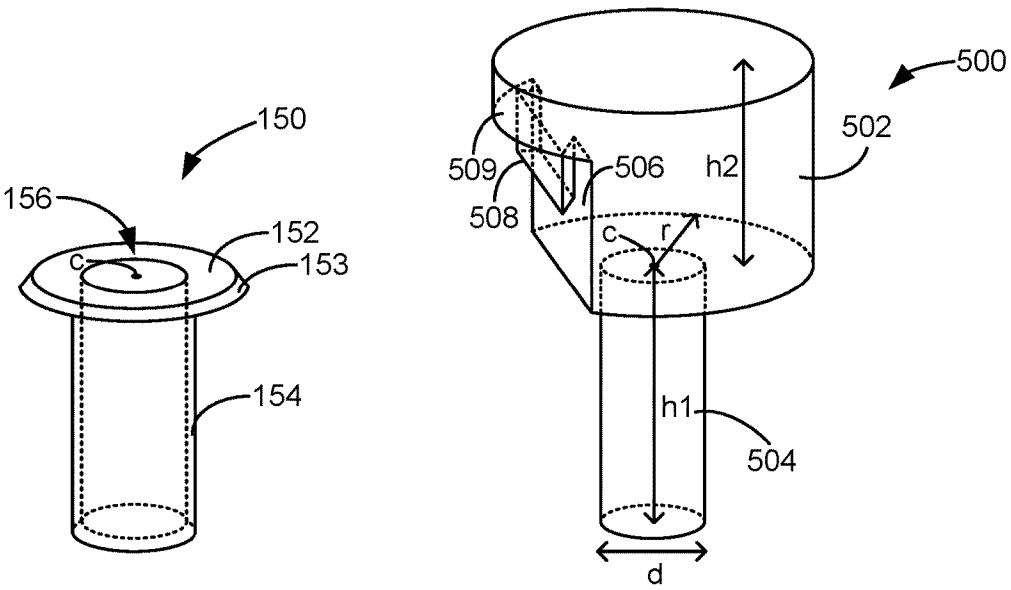
Figure 3
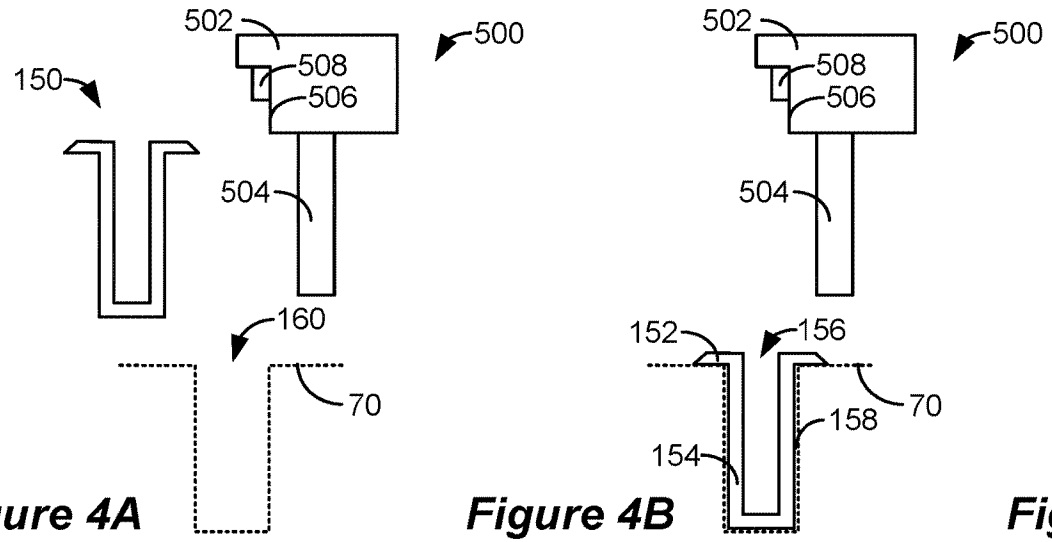
Figure 4A
Figure 4B
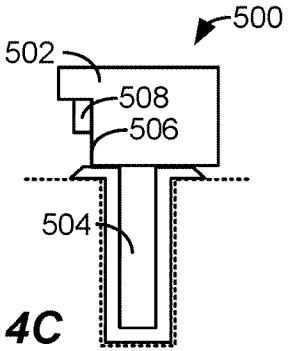
Figure 4C

APPARATUS FOR BARRICADING AN OUTWARD SWINGING DOOR TO PROVIDE PHYSICAL SECURITY

CROSS REFERENCE TO RELATED APPLICATIONS

This is a non-provisional application of U.S. Provisional Patent Application Ser. Nos. 63/046,832, filed Jul. 1, 2020 and 63/038,317, filed Jun. 12, 2020. These applications are incorporated herein by reference in their entireties, and priority to them is claimed.

FIELD OF THE INVENTION

This application relates to apparatuses for barricading a door, such as is useful in preventing forced entry into a dwelling or business.

INTRODUCTION

Various physical security measures can be used with doors at a dwelling or business that are designed to discourage forced entry into the premises. FIG. 1 shows a door 10, which is typically attached to a frame 12 by hinges 14. FIG. 1 shows various devices that have been used to provide physical door security, which are typically accessible to a user from inside the building being secured. These security measures are well known, and hence only briefly explained. In this example, the door 10 is hinged to allow it to pivot outwards of a building when the door 10 is opened, as is typical in a commercial or public building.

Element 20 comprises a latch which includes portions mounted (typically using screws) to both the door 10 and the frame 12 (or an adjacent wall more generally). The portion of the latch 20 affixed to the door 10 includes a slidable latch 22, which a user can slide to meet with a loop 24 on the portion affixed to the frame 12. Element 30 comprises a chain latch, which is generally similar to latch 20, although in this latch 30 the portion affixed to the door includes a chain 32 with a bit at its end. A user can position the bit within a slot 34 on the portion affixed to the frame 12. In either of latches 20 or 30, security against forced entry is provided by the sliding latch 22 or the chain 32. However, such security is not perfect. A force imparted outside the door such as from an assailant wishing forced entry can cause latches 20 or 30 to fail. Particularly, a sufficient force to the door 10—such as a force pulling the door outwards—can cause the sliding latch 22 or chain 32 to break, or can cause the screws affixing the devices 20 or 30 to become dislodged from either the door 10 or the frame 12.

Element 40 comprises a well-known door knob. When the knob is turned, a latch 44 is retracted into the door 10 from a recess 46 that has been morticed into the frame 12, thus allowing the door to be opened. When not turned, or when locked such as by using a key (not shown) or thumb turn 42, the latch 44 will remain extended in the recess 46, thus providing physical security against forced entry via force provided by the latch 44 against the door frame 12. Element 50 is typically called a "dead bolt." Like knob 40, dead bolt 50 includes a latch 54 which can be retracted from or extended into a recess 56 provided in the door frame 12, again using a key or a thumb turn 52. Door knobs 40 and dead bolts 50 also do not provide complete security against forced entry. In both cases, a sufficient outside force on the door 10 can cause the door knob 40 or dead bolt 50 to fail. Particularly, the recesses 46 or 56 morticed into the door frame 12 reduce the door frame material, thus weakening the material against external forces, raising the possibility that the latches 44 or 54 will break through the recesses 46 or 56. A strike plate (not shown) can be affixed (screwed) to the frame 12 over the recesses which will add further structural integrity against external forces, but such protection is limited by the strength of the screws involved.

Element 60 comprises another form of a door latch. In this example, a portion 64 is affixed to, or within, the door 10, which includes a sliding latch 66. This latch 66 can slide into a hole 68 morticed in the floor 70. The sliding latch 66 may be controlled by a key or thumb turn 62. Like latches 20 and 30 however, latch 60 can be prone to failure. A sufficient force outside the door 10 can cause the portion 64 affixed to the door 10 to become dislodged, or the latch 66 to be broken.

SUMMARY

A system useable to barricade a door is disclosed. The system may comprise: an anchor comprising an upper portion and a lower portion, wherein the lower portion is configured to be insertable in an opening in a floor proximate to an inside surface of the door; and a lock affixable to the door, wherein the lock comprises a stop and a key plate, wherein the stop is configured to be proximate to an outside surface of the door and the key plate is configured to be proximate to the inside surface of the door when the lock is affixed to the door, wherein the upper portion is configured to engage the key plate when the lower portion is inserted in the opening in the floor.

In one example, the lower portion and the opening in the floor are cylindrical. In one example, the lock further comprises a cross member that connects the stop and the key plate to affix the lock to the door. In one example, the stop and cross member comprise an integrated piece. In one example, the cross member comprises a bolt, wherein the bolt is configured to connect to the key plate though an opening in the key plate. In one example, the bolt comprises a threaded end, and further comprising a nut, wherein the nut is configured to affix to the threaded end of the bolt to connect the bolt to the key plate. In one example, the cross member is configured to connect the stop and the key plate through an opening in the door. In one example, the cross member is configured to connect the stop and the key plate around the door. In one example, an inside surface of the key plate is configured to contact the inside surface of the door, and an inside surface of the stop is configured to contact the outside surface of the door, when the lock is affixed to the door. In one example, the lower portion is configured to be vertically inserted into the opening in the floor. In one example, the key plate comprises a channel, and wherein the lower portion is configured to be insertable through the channel to insert the lower portion in the opening in the floor, wherein the upper portion is configured to engage the channel of the key plate when the lower portion is inserted in the opening in the floor. In one example, the channel, the opening in the floor, the upper portion and the lower portion, are each cylindrical. In one example, a cross section of the upper portion and the lower portion are equally sized. In one example, the upper portion comprises a first key and the key plate comprises a second key, wherein the upper portion is configured to engage the key plate by connection of the first and second keys when the lower portion is inserted in the opening in the floor. In one example, the first key is configured to connect with the second key by vertically inserting the first key into the second key, or by vertically inserting the second key into the first key, when the lower portion is vertically inserted into the opening in the floor. In one example, the upper portion comprises a first vertical planar surface, and wherein the first key is positioned on the first vertical planar surface. In one example, the second key is formed on a second vertical planar surface of the key plate. In one example, the first and second vertical surfaces are configured to slidably contact each other when the first key connects with the second key. In one example, the upper portion comprises an overhang above the first key. In one example, the overhang is configured to contact the key plate when the lower portion is vertically inserted into the opening in the floor. In one example, a bottom of the first key is configured to contact a bottom of the second key when the lower portion is vertically inserted into the opening in the floor. In one example, the system further comprises a receptacle, wherein the receptacle is configured to be positioned in a hole in the floor proximate the inside surface of the door, wherein the receptacle comprises the opening in the floor proximate to the inside surface of the door. In one example, an underside of the lower portion is configured to contact the receptacle when the anchor is placed in the receptacle. In one example, the upper portion is configured to engage the key plate when the lower portion is inserted in the opening in the floor and when the door is closed in a door frame.

BRIEF DESCRIPTION OF THE DRAWINGS

FIG. 3 show an example of the anchor and receptacle.

FIGS. 4A-4C show how the receptacle can be installed in a floor, and how the receptacle can thereafter receive the anchor.

DETAILED DESCRIPTION

Figure 2:
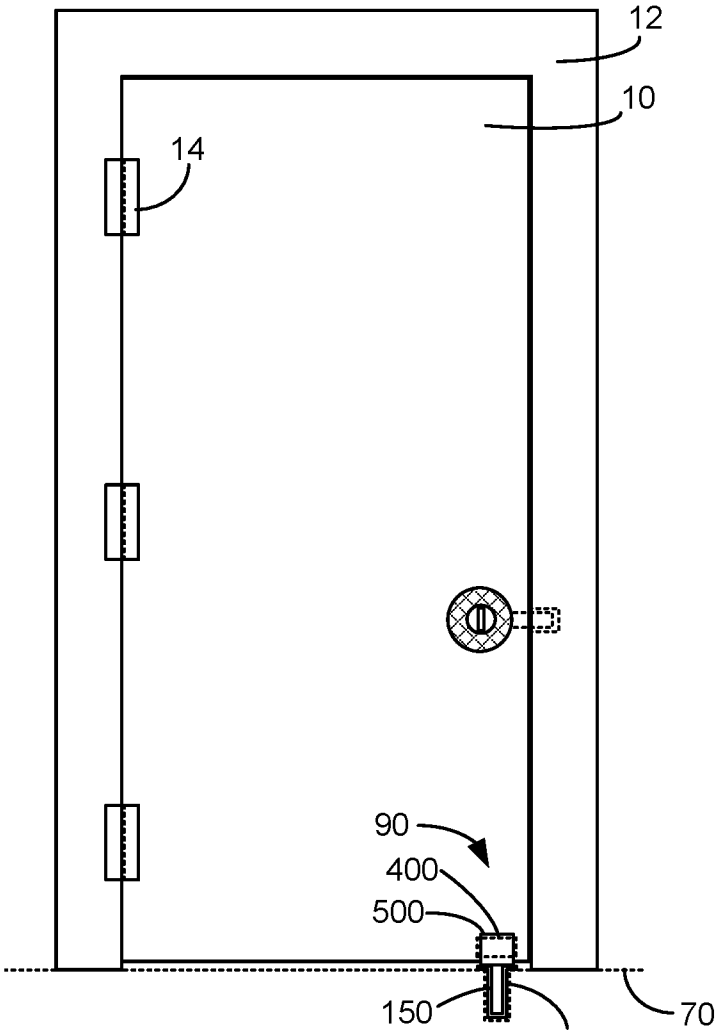
FIG. 2 shows a door barricading system, including an anchor, a lock, and a receptacle, in position relative to a door being barricaded.

By way of summary, and referring to element numerals described later herein, various aspects of Applicant's invention involve the use of a barricading system 90 to barricade a door 10 from forced entry. System 90 is particularly useful when applied to doors that swing outwardly, as is common in commercial and public buildings.

The system 90 includes an anchor 500 insertable by a user into a receptacle 150 mounted into a floor 70 on the inside on the door 10, and a lock 400 affixable to the door. The anchor 500 includes an upper portion 502 designed to connect with the lock 400, and a lower portion 504 that preferably fits within the receptacle 150. The lock 400 includes a stop 412 designed to contact the outside surface 10*a* of the door 10, and a key plate 404 on the inside of the door 10. When the anchor 500 is vertically inserted into the receptacle 150, the upper portion 502 of the anchor 500 engages the key plate 404 affixed to the door 10. Engagement between the anchor 500 and the key plate 404 can occur using corresponding keys on these components, or the anchor can be insertable through a vertical channel 430 on the key plate 404. Engagement between the anchor 500 and the lock 400 prevents the door 10 from swinging outwards: when an assailant wishing forced entry attempts to swing the door 10 outwards, the stop 412—which is ultimately mechanically connected to the floor 70 via the connected lock 400 and anchor 500—will barricade the door from opening. The anchor 500 can be removed from the receptacle 150 when the user doesn't desire to barricade the door, such as when the user may wish to open the door 10.

Figure 1:
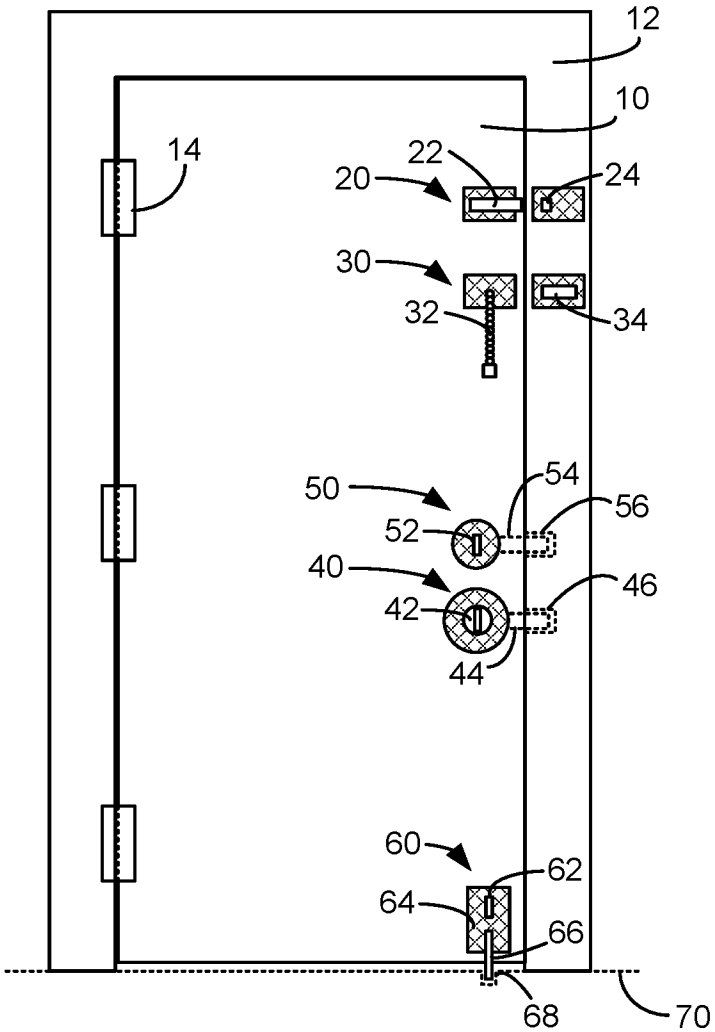
Figure 1 (prior art)
FIG. 1 shows various physical security measures that can be used with doors at a dwelling or business to discourage forced entry into the premises, in accordance with the prior art.

FIG. 2 shows a first example of a barricading system 90, which includes the anchor 500 and lock 400 just mentioned. FIG. 2 shows the anchor 500 in place with respect to a door 10 that is being secured. Specifically, the anchor 500 has been inserted into a receptacle 150 mounted into the floor 70 inside the door 10, and has been connected to the lock 400 affixed to the door 10. The connection between the anchor 500 and the lock 400 is established using keys 508 and 416 respectively positioned on these components, as explained further below. Note that a door 10 secured by the system 90 may be protected by other physical security measures as well, such as those described with respect to FIG. 1.

FIG. 3 shows the anchor 500 and receptacle 150 in isolation. The anchor 500 as mentioned above includes an upper portion 502 that includes a key 508, and a lower portion 504 that preferably fits within an opening 156 in the receptacle 150. In this example, both the upper and lower portions are formed from cylindrical pieces. This is preferred because cylindrical bar stock is easily accessible and cheap. That being said, the shape of these components 502 and 504 are not critical, and either of both can be made of different shapes. Preferably, the upper portion 502 includes a flat surface 506 into which the key 508 has been formed. Although not strictly necessary, an overhang 509 can be located above the key 508. These structures 506, 508, and 509 may be formed by milling the cylindrical upper portion 502.

The receptacle 150 includes a sidewall 154 whose inner diameter defines the size of the opening 156, and whose outer diameter is designed to fit in a hole 160 drilled in the floor 70. Preferably, the receptacle 150 also includes a horizontal lip 152 that overlies the floor 70 when the receptacle 150 is installed in the hole 160. The lip 152 may include a beveled edge 153 to smooth the transition from the top of the floor 70 to the top of the lip 152. Although not shown, the lip 152 may also be morticed into the floor 70 so that it is flush with the top of the floor. Furthermore, the lip 152 may be absent, in which case the receptacle 150 may include only the sidewall 154 which may be made flush with the top of the floor 70. In this regard, opening 156 in the receptacle 150 may be considered generally as an opening in the floor 70. Indeed, receptacle 150 isn't entirely necessary in the system 90, and instead the lower portion 504 can be inserted instead directly into an opening in the floor without the receptacle present.

FIGS. 4A-4C show steps involved in the installation of the receptacle 150, and subsequent use of the anchor 500 as part of the system 90. The lock 400 mounted to the door 10, to which the anchor 500 also connects, isn't shown in FIGS. 4A-4C but will be explained in subsequent figures. As shown in FIG. 4A, the hole 160 is drilled in the floor 70 proximate to and inside of the door 10. The location at which the hole 160 is drilled relative to the door 10 will depend on the dimensions of the anchor 500 and the lock 400, as explained subsequently. Typically, the floor 70 comprises a solid substrate such as a cement foundation, wood, or the like. After the hole 160 is drilled, and as shown in FIG. 4B, the sidewall 154 of the receptacle 150 is preferably secured within the hole 160, such as by the use of an adhesive or cementing material 158. Thereafter, as shown in FIG. 4C, the user may slide the lower portion 504 of the anchor 500 vertically downward into the receptacle's opening 156, which acts to barricade the door 10 when the anchor also connects with the lock 400 as explained subsequently. Preferably, the height (h1) of the lower portion 504 is equal to the depth of the opening 156, such that when the anchor 500 is positioned in place, the bottom of its upper portion 502 will rest on the upper surface of the lip 152 as shown in FIG. 4C. This provides stability, as well as keeps the anchor 500 from damaging the floor 70. That being said, if the receptacle 150 doesn't include a lip 152, the upper portion 502 may rest on the top surface of the floor 70. Because the lower portion 504 is designed to slide into opening 156 of the receptacle 150, this lower portion 504 and opening 156 would have the same shape (e.g., cylindrical, rectangular, etc.).

As just mentioned, the lower portion 504 of the anchor 500 is preferably sized to slide into the opening 156, and if both are cylindrical they also may rotate with respect to each other. That being said, these portions also preferably have a tight tolerance, such that the lower portion 504 is firmly retained (and will not "wiggle") within the opening 156. As explained later, the dimensions of the anchor 500 and the receptacle 150 can vary, and it should be understood that the drawings do not necessarily depict these components to scale. To provide some idea of envisioned sizing of the anchor 500 and receptacle 150, and referring to FIG. 3, the lower portion 504 may have a diameter (d) in the range of 0.5-1.5 inches and a height (h1) of 2.0-4.0 inches, which would also set the dimensions of the corresponding opening 156 in the receptacle 150. The upper portion 502 may have a height (h2) of 1.5-4.0 inches, and a radius r of 1.0-4.0 inches. These dimensions though are merely examples, and any dimensions for the anchor 500 can be used that enable the functionality as described herein.

FIGS. 5A-5D show the lock 400, which as noted earlier is mountable to the door 10 and connects to the anchor 500 when it is inserted in the receptacle 150. The lock 400 preferably comprises a number of pieces, including a key plate 404, a stop 412, and a horizontal cross member 408 such as a bolt. The bolt 408 and stop 412 may be formed as a single integrated piece as shown, and may be milled from cylindrical bar stock in one example. The key plate 404 contains the key 416 discussed earlier, and is mountable proximate to the inside surface 10*b* of the door 10. The bolt 408 passes through an opening 13 formed in the door 10 from its outside surface 10*a*, such that when the bolt 408 is connected to the key plate 404, the stop 412 is mounted proximate to the outside surface 10*a* of the door. As FIG. 2 suggests, opening 13 is preferably formed in the door 10 towards the bottom edge of the door, and preferably opposite the hinges 14, which allows the system 90 to barricade the door where the door swings open. The manner and position at which opening 13 is formed may depend on the material of the door, and may be formed through the bulk of the door (e.g., a wooden door) or through a mullion (e.g., the metal frame of a glass door). A drill bit 214 (FIG. 17) may be used to form the opening 13, and preferably the diameter of the opening 13 is just slightly larger than the diameter of the bolt 408.

Figure 5C:
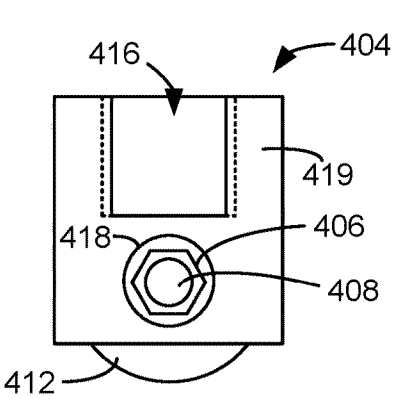
FIGS. 5A-5D show the lock and its components, and the manner in which the lock can be affixed to the door.
Figure 5A:
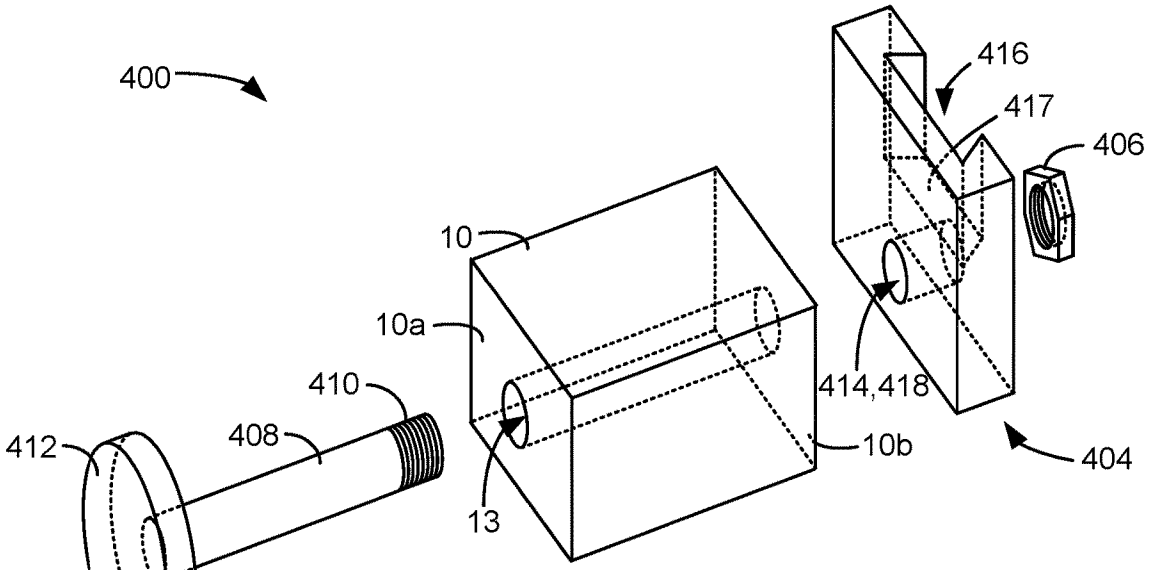
Figure 5D:
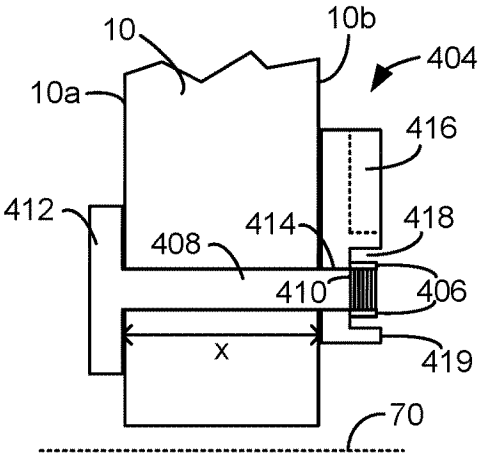
Figure 5B:
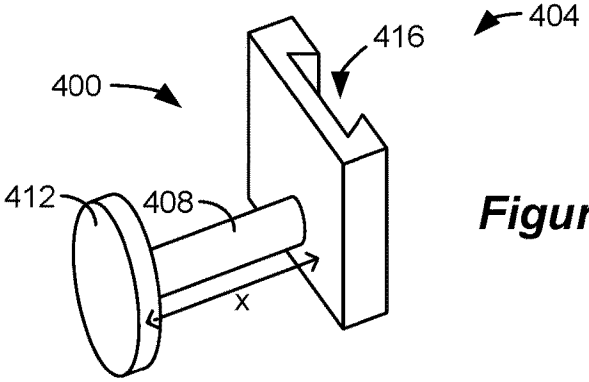

As best shown in FIG. 5A, the pieces of the lock 400 are connected through the opening 13 in the door using a fastener, such as a nut 406, which is connected to threads 410 on the end of the bolt 408. Specifically, the bolt 408 is passed through the opening 13 and through a horizontal opening 414 of the key plate 404. As best shown in the plan and cross-sectional views of FIGS. 5C and 5D, the key plate 404 includes a recess 418 to broaden out the diameter of the opening 414 to accommodate the nut 406 when it is affixed to the threads 410 of the bolt. As such, when the nut 406 is affixed, the nut is recessed below a planar surface 419 of the key plate 404. Having the nut 406 recessed in this fashion facilitates the connection of the anchor 500 to the key plate 404, as explained further below. FIG. 5B shows the stop 412, bolt 408, and key plate 404 as connected (e.g., using nut 406), but with the door 10 removed for easier viewing. In one example, when these components are affixed to each other, they are also firmly affixed to the door 10. In this regard, the dimensions of the components can be sized such that when connected to the door, the stop 412 is in firm contact with the outside surface 10*a* of the door, and the key plate 404 is in firm contact with the inside surface 10*b* of the door. In other words, the distance "x" between the inside surfaces of the stop 412 and the key plate 404 can roughly equal the thickness of the door. Although not shown, surfaces of the key plate 404 and stop 412 that contacts the surfaces 10*b* and 10*a* of the door 10 can include pads comprised of a high-density rubber or plastic. Such pads can help protect the door 10 from becoming marred by the lock 400, and may help to absorb an external force F that might be applied to the door 10, as explained further below.

The anchor 500, lock 400, and receptacle 150 may be made of various materials, and preferably are formed of materials with good mechanical strength able to provide barricading functionality without breaking. For example, these components may be formed of aluminum, steel, or high-density plastics such as PTFE, high-density rubbers, etc. The anchor 500, lock 400, and receptacle 150, or their components, may be milled, cut or molded to the correct shapes to provide the barricading functionality described. The anchor 500—i.e., the upper and lower portions 502 and 504—is preferably solid for best mechanical strength. However, in other examples, the upper and lower portions 502 and 504 may be hollow to some degree, which can be useful to reduce the weight of the anchor 500. The upper portion 502 may also be designed with different shapes to reduce weight or ease manufacturing, as described later with respect to FIGS. 9A and 9B.

Figure 6:
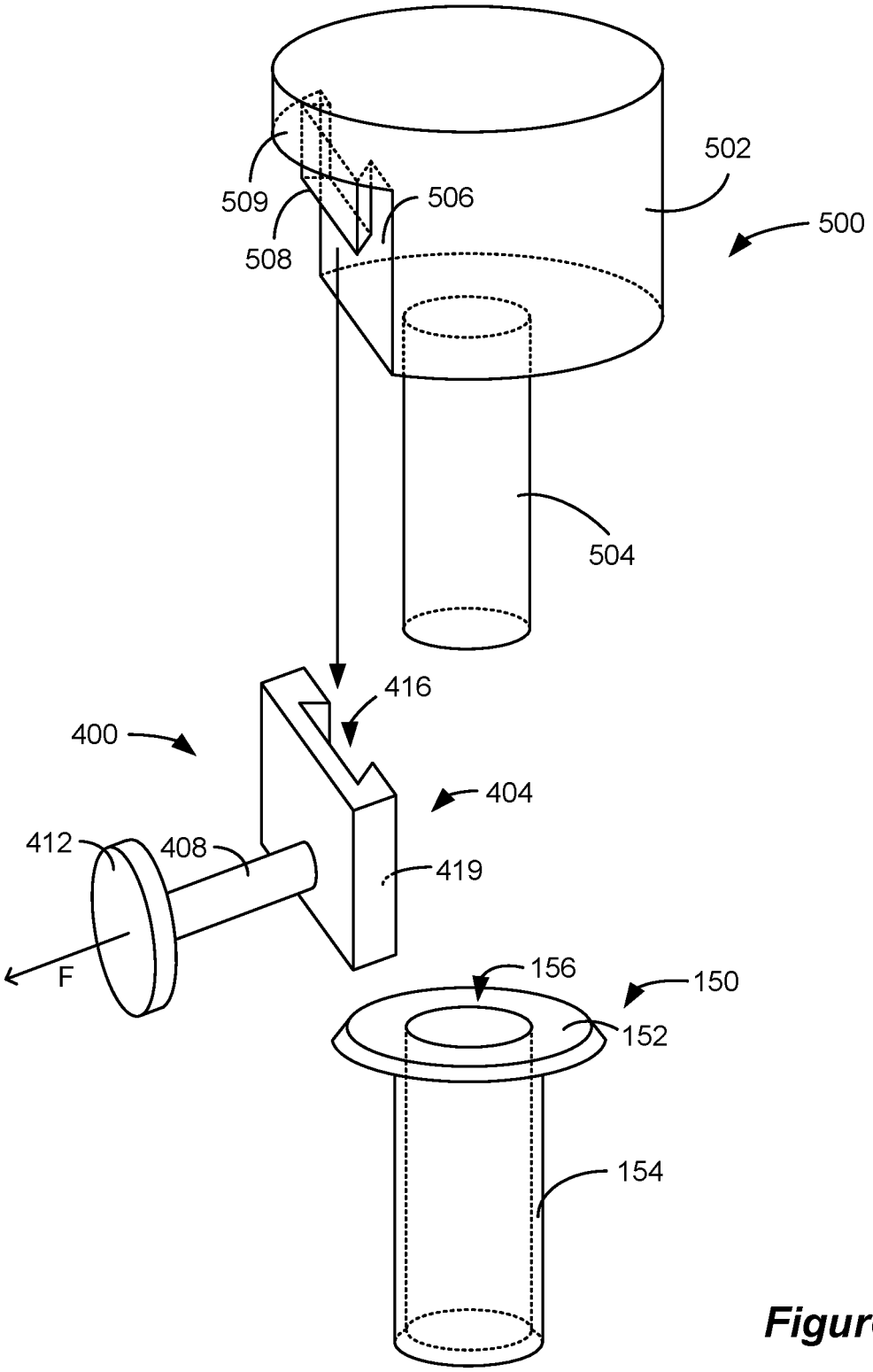
FIG. 6 shows how the anchor can be simultaneously vertically inserted into the receptacle and into the lock.

FIG. 6 shows connection of the anchor 500 to the lock 400 as would occur when the anchor 500 is being used to barricade a door 10 to which the lock 400 is affixed. In FIG. 6, the door 10 to which the lock 400 is affixed isn't shown for simplicity. The lower portion 504 of the anchor 500 is slipped vertically into the opening 156 in the receptacle 150 by a user as described earlier. At the same time that the lower portion 504 is inserted, the key 508 of the anchor 500 is vertically inserted into the key 416 on the key plate 404. In the example shown, the key 508 on the upper portion 502 of the anchor 500 can be viewed as a male key insertable into a female key 416 of the key plate 404. However, these could also be reversed, with the upper portion 502 including a female key and the key plate 404 including a male key. In the example shown, the keys have angled edges, and are roughly trapezodial in shape, although other shapes (e.g., "T" shapes) could be used for the keys as well. In this manner, when key 508 slips vertically into key 416, the lock 400 is firmly held to the anchor 500, such that a horizontal force F cannot pull them apart. Notice that the simultaneous vertical insertion of the lower portion 504 into the receptacle 150 and the key 508 into key 416 requires proper sizing of the components as well as proper positioning of the receptacle 150 with respect to the door-mounted lock 400.

The keys 416 and 508 can be connectable in other manners, and such connection does not necessarily need to simultaneously coincide with vertical insertion of the lower portion 502 into the opening 156 of the receptacle 150. For example, the keys 416 and 508 can be connected after the lower portion 502 has been inserted into the receptacle 150, such as by clamping, snapping, or by other mechanisms.

Notice that when the anchor 500 is vertically inserted into the lock 400, the anchor 500 can "bottom out" in one or more of a number of different ways. First, the bottom of the lower portion 504 can contact the bottom of the opening 156 in the receptacle 150. Second, the bottom of the upper portion 502 can contact the floor 70 or the lip 152 of the receptacle 150 if present. Third, the bottom of the key 508 can contact the bottom 417 (FIG. 5A) of key 416. Fourth, the overhang 509 can contact the top of the key plate 404. Preferably, the components of the system 90 are sized and installed such that some or all of these various points of contact are established simultaneously when the anchor 500 is vertically installed (see, e.g., FIG. 7B), although this isn't strictly necessary. Further, when the anchor 500 is vertically inserted into the lock 400, tolerances may be such that the planar surfaces 419 and 506 of the lock 400 and the upper portion 502 are bought into contact. While this isn't strictly necessary, sizing the components in this manner provides for a tight tolerance between the anchor 500 and the lock 400 while still permitting them to be vertically slidable with respect to each other. Notice as discussed earlier that recessing 418 the nut 406 (FIGS. 5C and 5D) facilitates contacts between planar surfaces 419 and 506.

Figure 7B:
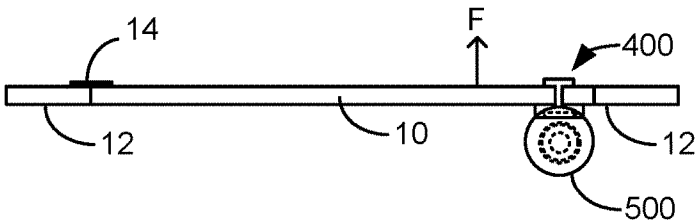
FIGS. 7A-7B show operation of the system to barricade a door when it is closed in a door frame.
Figure 7B:
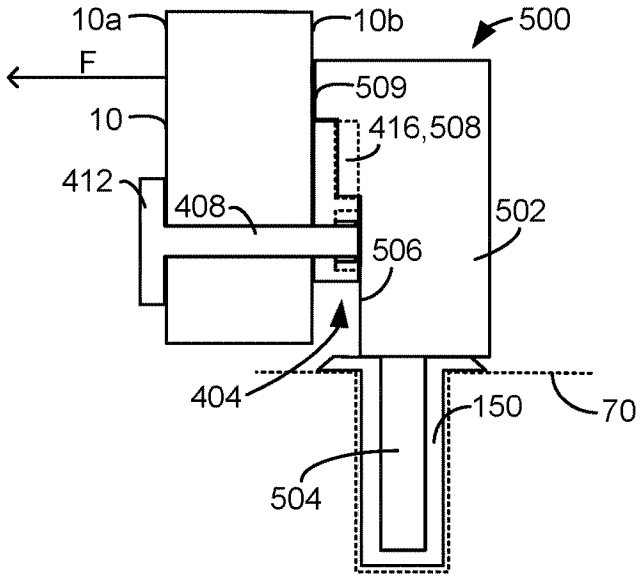
Figure 7A:
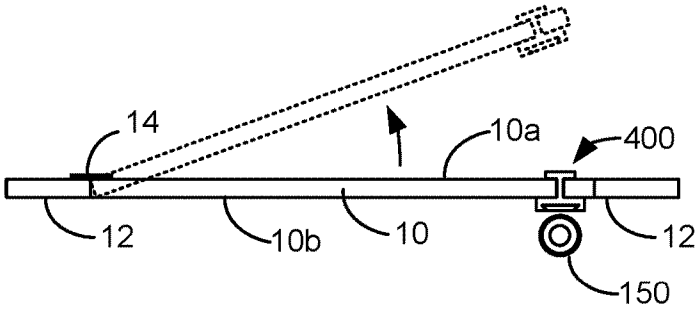
Figure 7A:
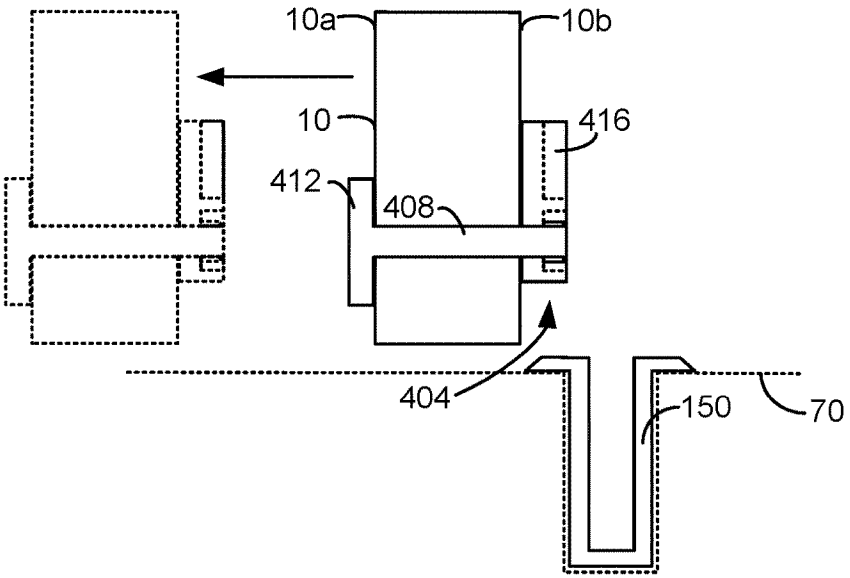

FIGS. 7A and 7B show use of the door barricading system 90 in both top-down and cross-sectional views. As noted earlier, the receptacle 150 is preferably mounted in the floor 70 just inside the door 10 (e.g. a few centimeters), and proximate to the inside surface 10*b* of the door. The lock 400 has been attached to the door 10 as explained earlier. In FIG. 7A, the user has not placed the anchor 500 in the receptacle 150, and as a result, the door 10 is not barricaded and can be opened (swung outward) by a user inside the door 10.

In FIG. 7B, the user has closed the door 10 within frame 12, and has placed the anchor 500 within the receptacle 150, which as explained earlier also connects the anchor 500 to the door-mounted lock 400 at keys 416 and 508. As such, the system 90 provides a barricading function to prevent the door 10 from opening when subject to an external force F, such as that provided by an assailant wishing forced entry. Specifically, attempting to swing the door 10 outward (F) brings the outside surface 10*a* of the door into contact with the stop 412. The stop 412 is firmly held to the key plate 404 (via nut 406), and the key plate 404 is firmly held to the anchor 500 via the keys 416 and 508. Force F is thus transferred to the lower portion 504 of the anchor 500, which is firmly held in place within the floor 70, thus preventing the door 10 from swinging outwards. Of course, should a user decide to open the door 10 at some later time, he can simply remove the anchor 500 from the receptacle 150 (FIG. 5A) and place or store it near the door 10 for later use.

Notice that height h1 of the lower portion 504 (FIG. 3) makes it unlikely that an assailant outside the door 10 could pry the anchor 500 out of the receptacle 150, such as by attempting to reach under the door with a tool. The significant weight of the anchor 500 also inhibits such external tampering. Furthermore, because the lock 400 is affixed to the door 10 using a mechanism accessible only from the inside of the door 10 (e.g., nut 406), an assailant outside the door 10 would not be able to remove the lock 400 (such as by loosening the nut 406). Especially given the mechanical strength and thickness of the materials involved, the system 90 will be able to withstand an external force F without breaking. Furthermore, notice that the design of the system 90 is simple, and involves few parts that are easily and cheaply manufactured. Notice also that the lock 400 is attached through the bulk of the door 10 with parts in contact with the door 10 such as stop 412 and key plate 404 having substantial surface areas. This is beneficial compared to other security approaches that merely attach a mechanism to one side of a door (e.g., with screws), which can be a point of weakness that can break in response to the force F. Still further, the system 90 does not involve moving parts (e.g., latches, chains, etc.), which can also break. In short, good and reliable barricading functionality is provided by the system 90 in a cost-effective manner that is easy to manufacture, install, and use.

While described as being particularly useful when applied to barricade an outwardly-swinging door 10 as shown, notice that the system 90 also barricades the door should an assailant attempt to force the door inward. Because the surfaces 419 and surfaces 506 of the lock and upper portion 500 can touch, and/or because the overhang 509 can be sized to contact the inside surface 10*b* of the door directly, an inward force on the door will also ultimately be transferred to the lower portion 504 held firmly within the floor.

Figure 8A:
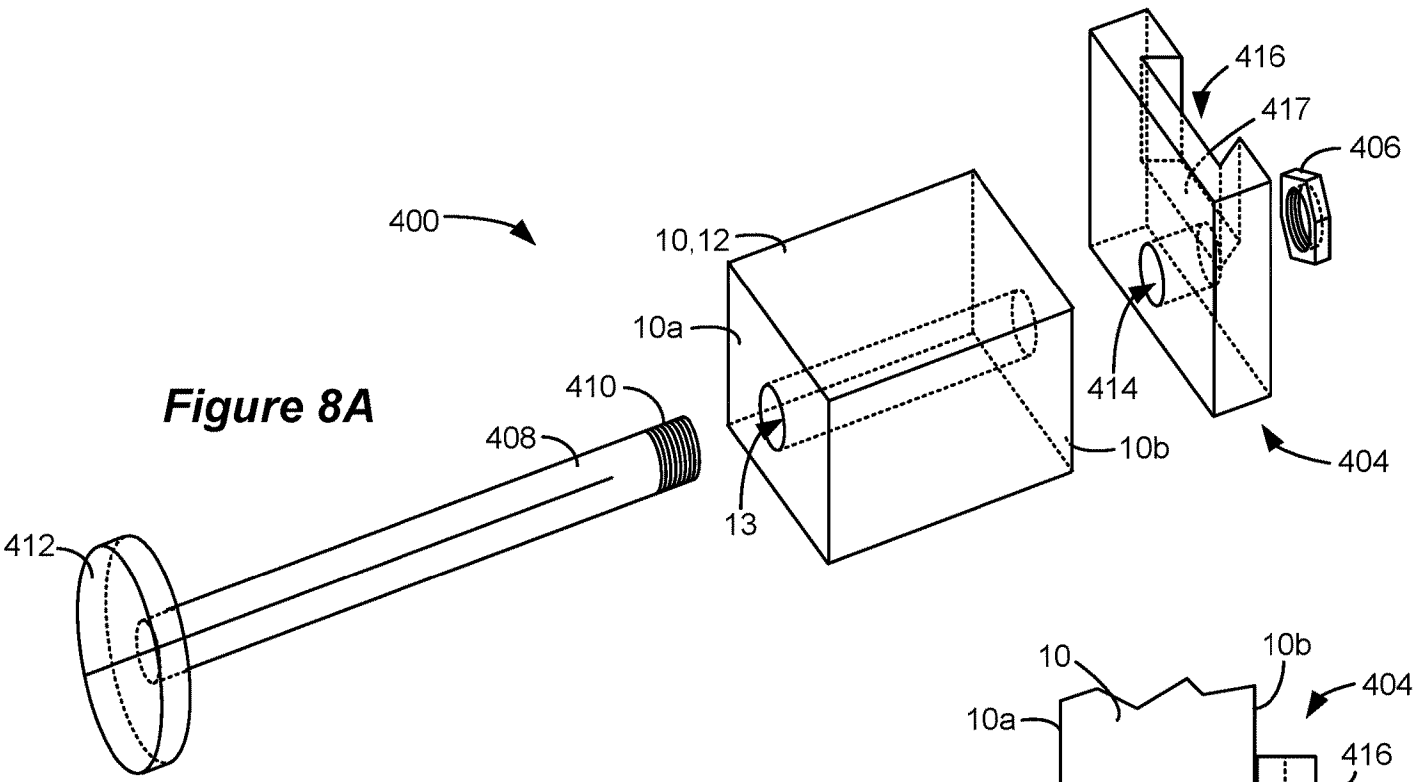
FIGS. 8A-8D show a modification to the system that allows the door to be barricaded while still allowing the door to be opened by a gap.
Figure 8B:
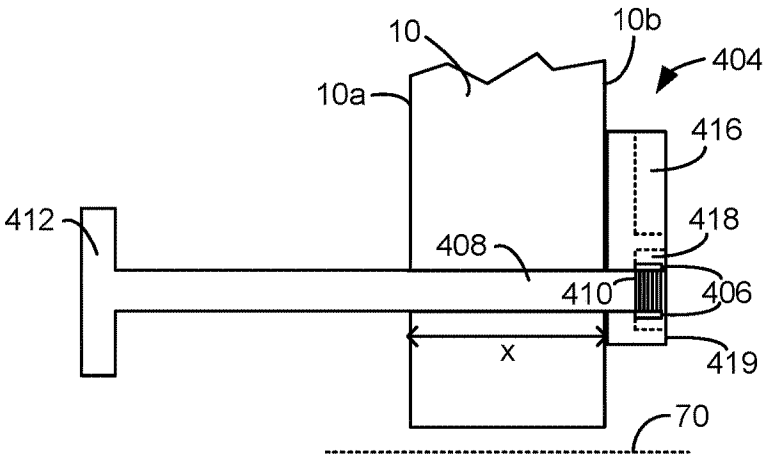
Figure 8D:
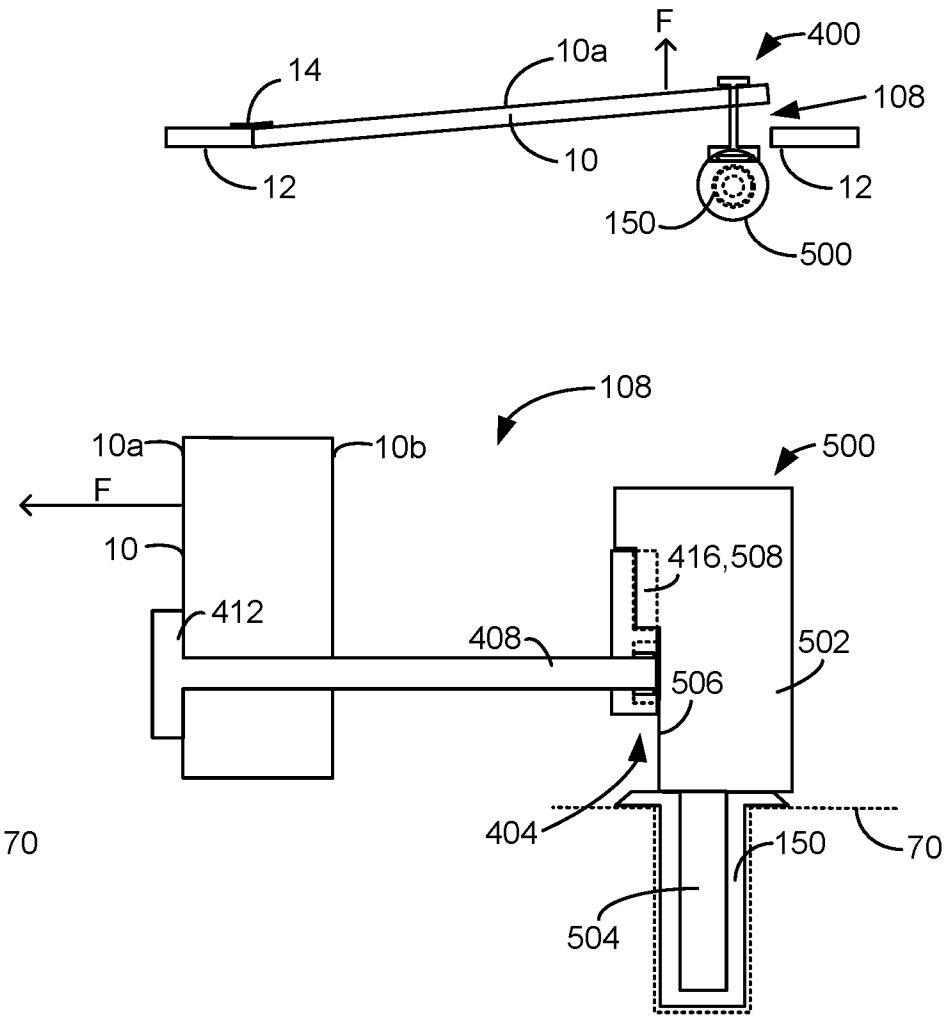
Figure 8C:
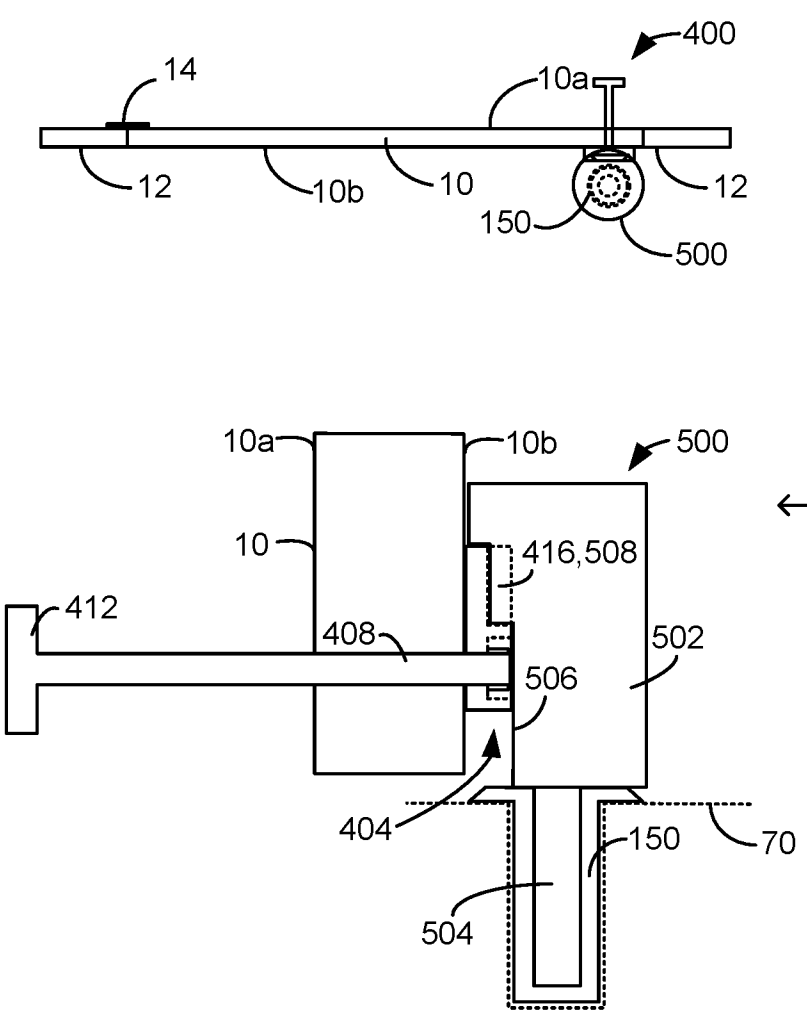

The system 90 as illustrated to this point is configured to barricade the door 10 when the door 10 is closed in its frame 12. However, the system 90 may be varied to allow the door 10 to be opened slightly while still being barricaded against forced entry. FIGS. 8A-8D show a modification to system 90 that permits this. The system 90 is essentially the same as described earlier, but in this example, the bolt 408 is made longer, such as that when the lock 400 is affixed to the door, the stop 412 is not proximate the outside surface 10*a* of the door, as best shown in FIG. 8B. FIGS. 8C and 8D show this modified system 90 in operation. FIG. 8C shows the system 90 when the door 10 is closed in the frame 12. FIG. 8D shows the system 90 when after the door 10 has been opened slightly. In this configuration, the door eventually hits the stop 412, which permits the door to be opened by a small gap 108. Nevertheless, the stop 412 prevents the door from opening further than this, and so the door is barricaded as explained earlier. System 90 of FIGS. 8A-8D may be useful in a given application because it barricades the door while still allowing a user on the inside to look through the gap 108 to verify the identity of a person on the outside of the door, and/or to receive an item (e.g., a letter) through the gap while not opening the door completely.

Figure 9B:
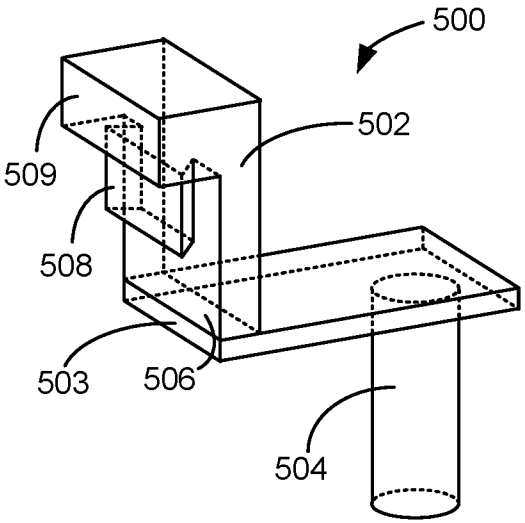
FIGS. 9A and 9B show modifications to the anchor.
Figure 9A:
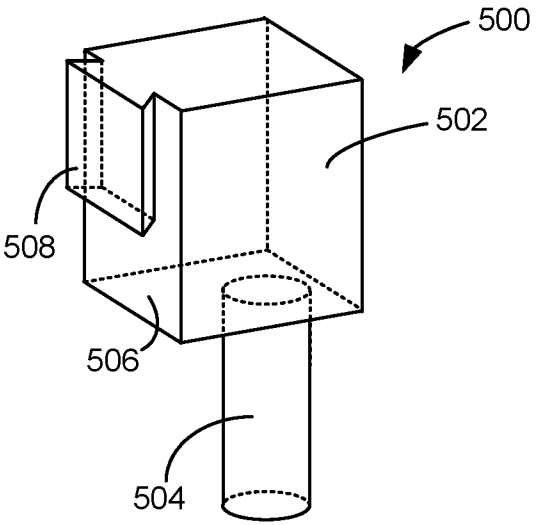

FIGS. 9A and 9B show other designs for the anchor 500. FIG. 9A shows an anchor 500 in which the upper portion 502 is not cylindrical but instead is rectangular. The upper portion 502 retains certain aspects described earlier, such as key 508 and flat surface 506. However, in this example, the anchor 500 does not include an overhang 509 as shown in earlier examples. Overhang 509 as explained earlier can come into contact with the top of the key plate 404 when the anchor 500 is vertically inserted, although this isn't strictly necessary because the anchor 500 can bottom out on other surfaces. In FIG. 9A, the lower portion 504 is not centered underneath the upper portion 502, but is instead offset. However, the lower portion 504 could also be centered below the upper portion 502 in other examples. In FIG. 9B, the lower portion 504 is not underneath the upper portion 502 at all, and instead a horizontal connecting portion 503 is used to connect these portions, as shown in FIG. 9B. Connecting portion 503 may be made of the same materials as the upper and lower portions 502 and 504, and may be considered as a part of, and may be formed with, either of these portions.

Figure 10B:
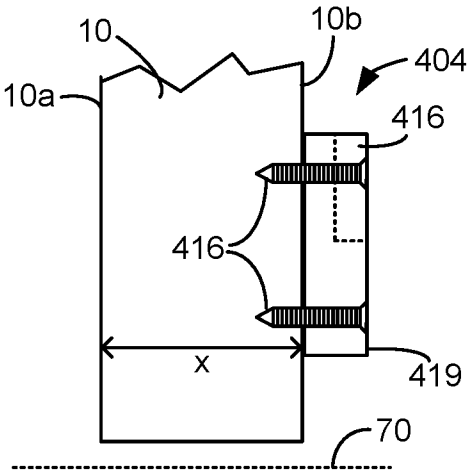
FIGS. 10A and 10B show a modification to the lock in which the key plate is affixed to the inside surface of the door.
Figure 10A:
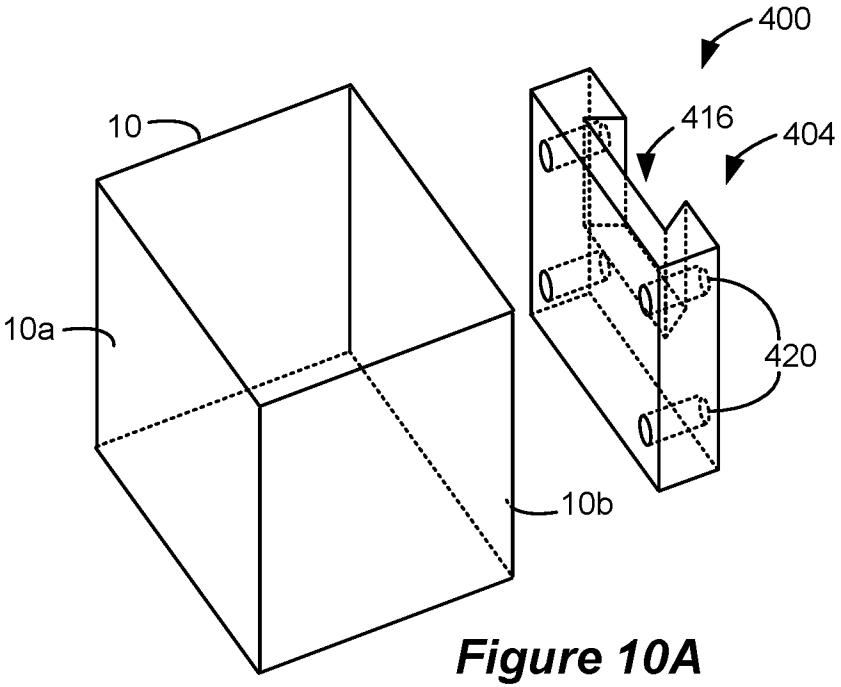

FIGS. 10A and 10B show a modification to the lock 400. In this example, the lock 400 lacks a bolt 408 passing through an opening 13 in the door, and further lacks a stop 412 on the outside surface 10*a* of the door 10. In effect, the lock 400 as shown in this example comprises only a key plate 404 which is affixed to the inside surface 10*b* of the door. The lock 400 can be affixed in different manners, but in the example shown the key plate 404 includes screw holes 420 to accommodates screws 421 which pass through the holes 420 and affix into the material of the door 10. Otherwise, the lock 400 operates in conjunction with the anchor 500 (not shown) to barricade the door as explained earlier. This example may not be suitable for all implementations, because it may not be as secure as earlier examples in which the lock 400 includes a stop 412 on the outside of the door 10: for example, a sufficient external force F may pull the screws 421 from the door. That being said, lock 400 in FIGS. 10A and 10B may still be suitable for some applications. Furthermore, the lock 400 may be included with or affixable to structures on the inside of the door having sufficient mechanical strength. In one example, the lock 400 may be included as part of a kickplate (not shown) affixed to the bottom inside surface of the door 10.

Figure 11B:
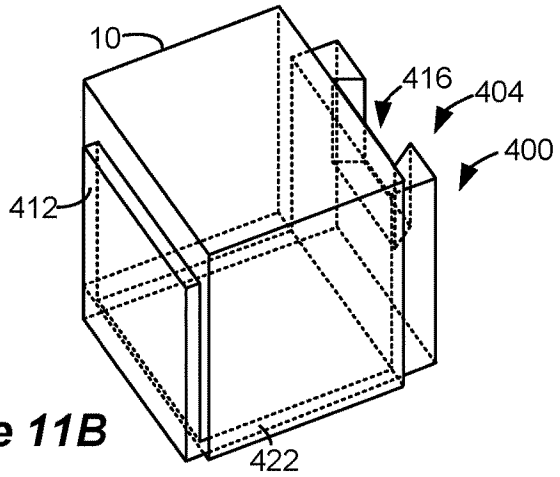
FIGS. 11A-11C show a modification to the lock in which the lock does not require a bolt affixed through the door.
Figure 11C:
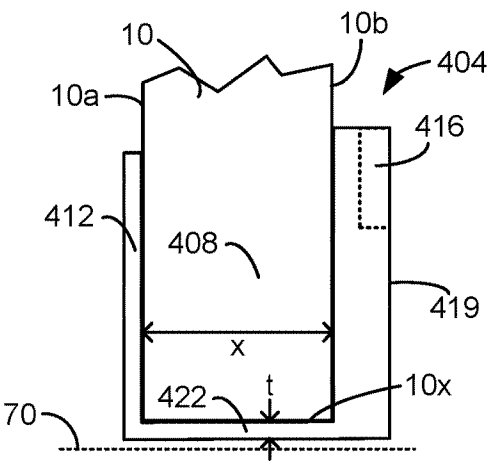
Figure 11A:
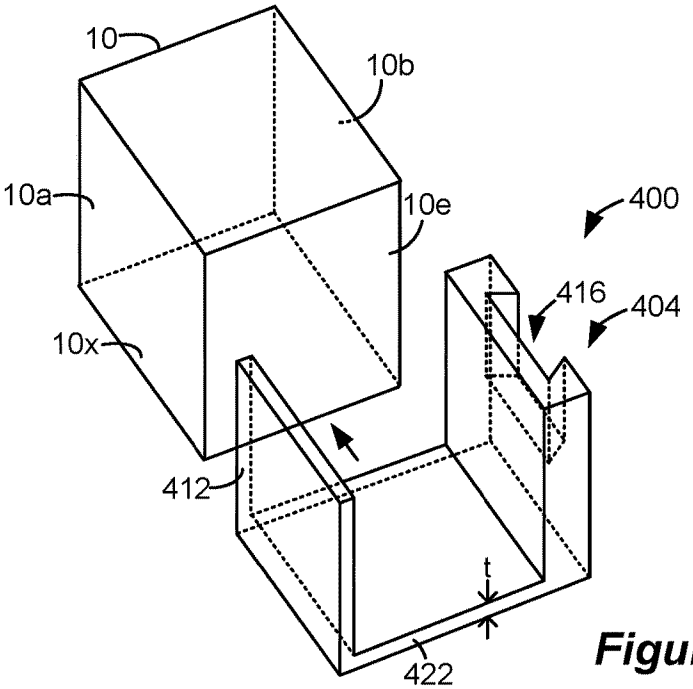

FIGS. 11A-11C show another modification to the lock 400. In this example, the lock 400 again lacks a bolt 408 passing through an opening 13 in the door. However, the lock 400 still includes a stop 412 on the outside surface 10*a* of the door 10. In this example, the lock 400 includes a horizontal cross member 422 which connects the vertical key plate 404 and the vertical stop 412 around the door. These components may be formed as a single integrated piece, such as milled from a single piece of material, or they may comprise separate affixable components. As best shown in FIG. 11A, the lock 400 is essentially C-shaped and can be slipped underneath the door 10. Specifically, and as shown in FIGS. 11A and 11B, the lock 400 can be slipped underneath the swinging edge 10*e* of the door 10, such that the horizontal cross member 422 contacts the underside 10*x* of the door, the key plate 404 contacts the inside surface 10*b* of the door, and the stop 412 contacts the outside surface 10*a* of the door. Preferably, the lock 400 is dimensioned such that the inside surfaces of the key plate 404 and stop 412 are spaced at a distance equal to the thickness 'x' of the door 10. In this way, the lock 400 may self-affix to the door by friction, as best seen in the cross section of FIG. 11C. Alternatively, the lock 400, once positioned in placed on the door 10 (relative to the receptable 150; not shown), can be affixed to the door using bolts or screws (not shown). Notice as shown in FIG. 11C that the thickness 't' of the horizontal cross member 422 is preferably less than the clearance between the underside 10*x* of the door 10 and the floor 70. In this way, the lock 400 may be affixed to the door 10 while still allowing the door to swing open. The example of the lock 400 shown in FIGS. 11A-11C is advantageous because it provides a stop 412 on the outside surface 10*a* of the door, thus barricading the door when the lock is attached to the anchor 500 (not shown). However, this occurs without the need of drilling an opening 13 through the door 10 to connect the stop 412 to the key plate 404. Further, while the lock 400 is not subject to tampering from an assailant of the outside of the door, a user inside the door 10 may remove (e.g., slide off) the lock 400 later if so desired, leaving the door unblemished.

Figure 12A:
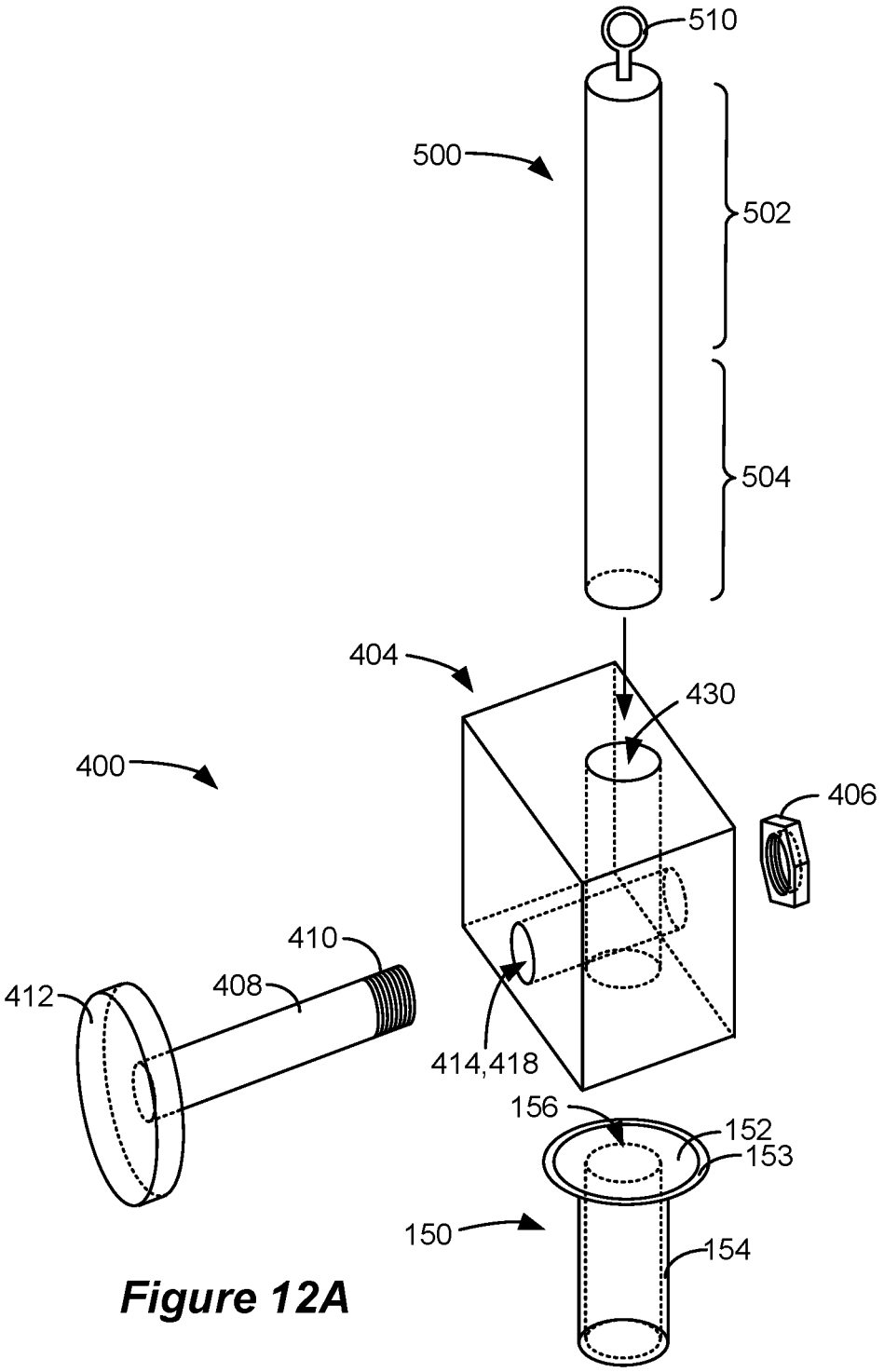
FIGS. 12A-12C show a modification in which the body of the anchor is positioned through the lock.
Figure 12C:
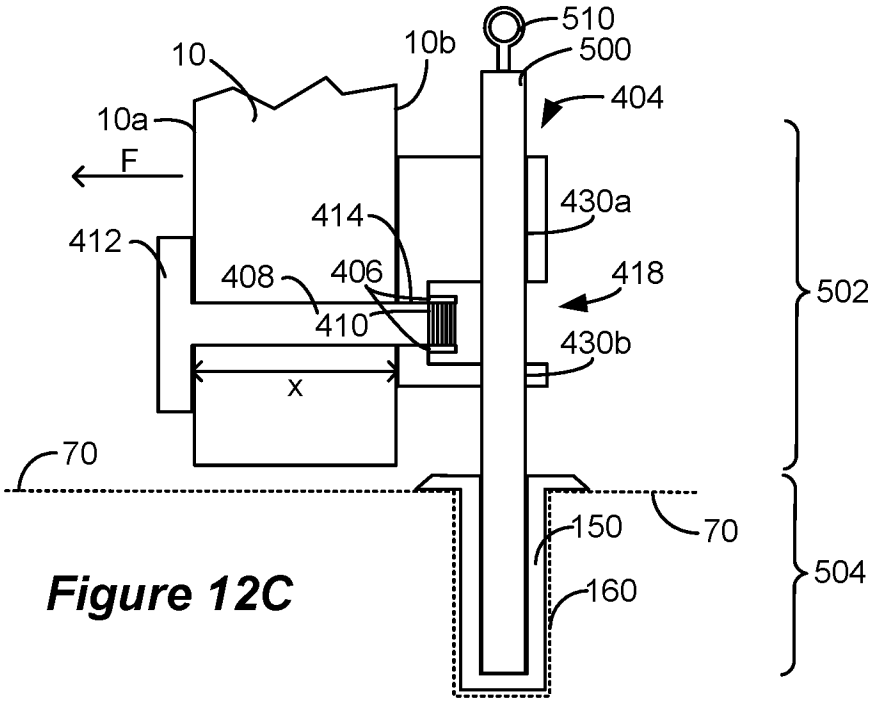
Figure 12B:
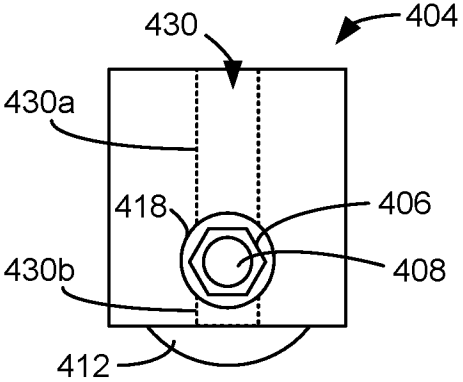

FIGS. 12A-12C show another example of how the lock 400 and anchor 500 can be designed. In this example, keys 416 and 508 are not used to connect the lock 400 with the anchor 500. Instead, the lock 400, and in particular the key plate 404, is designed with a channel 430 that passes vertically through the material of the key plate 404. In the depicted example channel 430 is cylindrical, but could comprise other shapes as well. As before, the key plate 404 includes a horizontal opening 414 to receive a bolt 408 to allow the lock 400 to be affixed to the door, and opening 414 can again include a recess 418 to receive the nut 406 that affixes to the end of the bolt 408, as better shown in the plan and cross-sectional views of FIGS. 12B and 12C. The channel 430 is designed to pass through the recess 418 in the horizontal opening 414 as best shown in FIG. 12C, such that the channel 430 is not obstructed by the bolt 408 and nut 406. The channel 430 can be viewed as having portions 430*a* and 430*b* above and below the recess 418, as shown in FIGS. 12B and 12C. As mentioned, the anchor 500 and the key plate 404 do not comprise keys 508 and 416 in this example, but keys could also be included as before.

Referring again to FIG. 12A, the anchor 500 is designed to slip into and through the opening 430 and into the opening 156 in the receptacle 150 in the floor 70 to barricade the door. In this regard, the anchor 500 as before comprises a lower portion 504 configured to be received by the receptacle 150, and an upper portion 502 designed to engage the key plate 404 when the anchor 500 is inserted. In the example shown, the anchor 500 comprises a cylinder of a constant diameter in cross section, and thus in this example the upper and lower portions 502 and 504 have equal shapes and sizes in cross section. This facilitates forming the anchor as a single integrated piece. However, this is not strictly necessary, and the upper and lower portions 502 and 504 can have different shapes as before. For example, although not shown, the lower portion 504 may be cylindrical while the upper portion 502 is rectangular. It is preferred that the receiving elements for the anchor 50 be of similar shapes—e.g., that the opening 156 in the receptacle 150 also be cylindrical and that the channel 430 in the key plate 404 also be rectangular. This provides a tight tolerance for the anchor 500 when it is positioned in place to barricade the door, while still allowing the anchor 500 to slide vertically relative to the key plate 404 and the receptacle 150. That being said, it is not strictly necessary that the portions 502 and 504 of the anchor 500 have the same shape as receiving elements 430 and 156.

Barricading functionality of the system 90 in FIGS. 12A-12C is established similarly as in earlier examples. When the anchor 500 is inserted (FIG. 12C) and the door 10 is subject to an external force F, the outside surface 10*a* of the door contacts the stop 412. The stop 412 is firmly held to the key plate 404 (via nut 406), and the key plate 404 is firmly held to the anchor 500 via engagement of the upper portion 502 with the channel 430. Force F is thus transferred to the lower portion 504 of the anchor 500, which is firmly held in place within the floor 70, thus preventing the door 10 from swinging outwards. Should a user decide to open the door 10 at some later time, he can simply remove the anchor 500 from the receptacle 150. In this regard, a handle 510 may be provided on the top of the anchor 500 to assist a user in inserting and removing the anchor 500 from the lock 400 and receptacle 150.

The design of the anchor 500 and lock 400 in FIGS. 12A-12C can ease installation of the system 90 and ensure that the components of the system will properly connect. For example, the lock 400 can be affixed to the door 10. A drill bit (e.g., 210, FIG. 17) can then be passed through the channel 430 and down to the floor 70 to drill the hole 160 that will receive the receptacle 150. Because the hole 160 may need to be of larger diameter that the opening to accommodate the receptacle 150, a second larger diameter drill bit may be used to broaden the hole 160 before insertion of the receptacle 150. Passing the (initial) drill bit through the opening 430 helps to ensure that the receptacle 150 will be properly aligned with the lock 400, and thus that the lock 400 and receptacle 150 will be able to smoothly vertically receive the anchor 150 without misalignment.

Figure 13A:
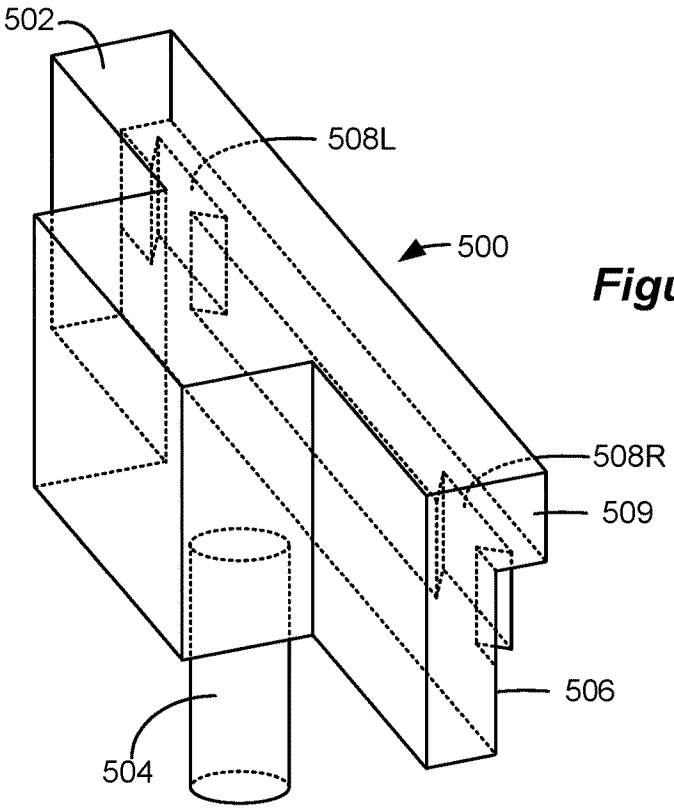
FIGS. 13A and 13B show another modification in which the anchor can be used to barricade two (double) doors.
Figure 13B:
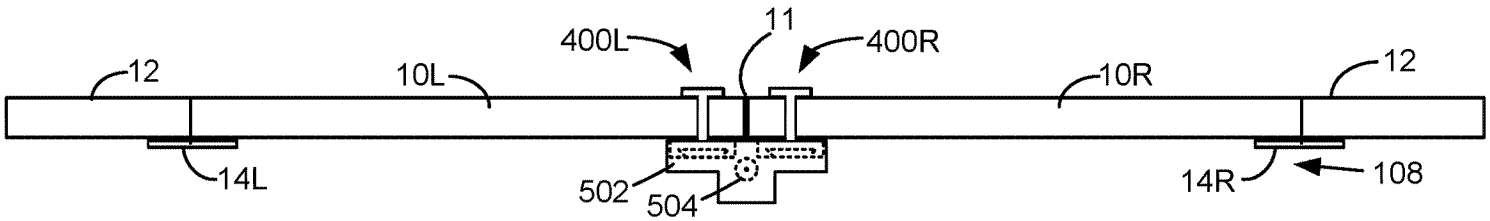

Some doors that a user might wish to barricade may be double doors, with left and right doors 10L and 10R that are both openable and potentially vulnerable to forced entry. Variations can be made to the system 90 to allow it to barricade such double doors, and an example is shown in FIGS. 13A and 13B. As shown in FIG. 13A, a double-door anchor 500 includes as before an upper portion 502 and a lower portion 504. The upper portion 502 as before can include a flat surface 506. However, in this example, two keys 508L and 508R are provided on the flat surface 506. Two corresponding locks 400L and 400R are correspondingly affixed to left and right doors 10L and 10R. Although the details aren't shown, these locks 400L and 400R may be constructed in any of the manners described earlier, with each including a key 416 to connect with the keys 508L and 508R. Thus, when a user desires to barricade both doors, the lower portion 504 is vertically inserted into receptacle 150 (not shown), which simultaneously inserts keys 508L and 508R into the keys 416 of the locks 400L and 400R, thus barricading the doors 10L and 10R against swinging open.

Figure 14:
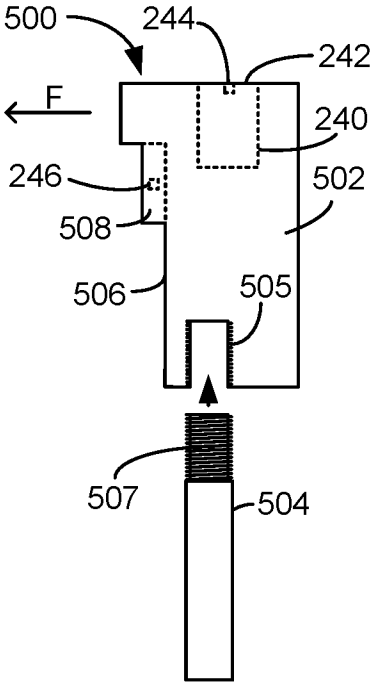
FIG. 14 shows that the stop may be formed of more than one piece, and further shows the inclusion of optional electronics in the system.

FIG. 14 shows further modifications that can be made to the anchor 500. FIG. 14 shows that the anchor 500 can be made from components that are affixed together, such as the upper portion 502 and lower portion 504 which in this example comprise separate affixable pieces. As shown, lower portion 504 can include a threaded end 507 that can be screwed into a threaded opening 505 formed on the underside of the upper portion 502. This may be easier and cheaper to manufacture compared to forming the anchor 500 (upper and lower portions 502 and 504) as a single piece.

FIG. 14 also shows that electronics can be incorporated with the anchor 500. In this regard, part of the upper portion 502 can be hollowed out to include an electronics chamber 240 covered by a lid 242. The lid 242 can include a light source such as a light emitting diode (LED) 244. This is useful as it allows the anchor 500 to act as a night light, or to otherwise indicate the location of the anchor, which might be useful to prevent a person from tripping on the anchor when it is in use to barricade the door. Although not shown, one skilled in the art will understand that the electronics chamber 240 could include a battery and necessary circuitry (e.g., a circuit board) to run the LED. Further, although not shown, the lid 242 could include an on/off switch to operate the LED 244.

Anchor 500 can also include a pressure sensor 246 to sense a force F that has been imparted to the anchor. The pressure sensor 246 can be positioned on the key 508 or elsewhere on the anchor 500 at a location that is capable of sensing force F. The pressure sensor 246 can be any device capable of sensing force, such as a load cell or an accelerometer. If the sensor 246 and associated electronics detects a force beyond a threshold, i.e., a large force that would suggest that unauthorized entry into the premises is being attempted, the anchor 500 can wirelessly notify the user (e.g., their cell phone) or the premise's home security system of that fact. In this regard, the electronics in chamber 240 could include telemetry circuitry (e.g., a Bluetooth antenna).

Figure 15:
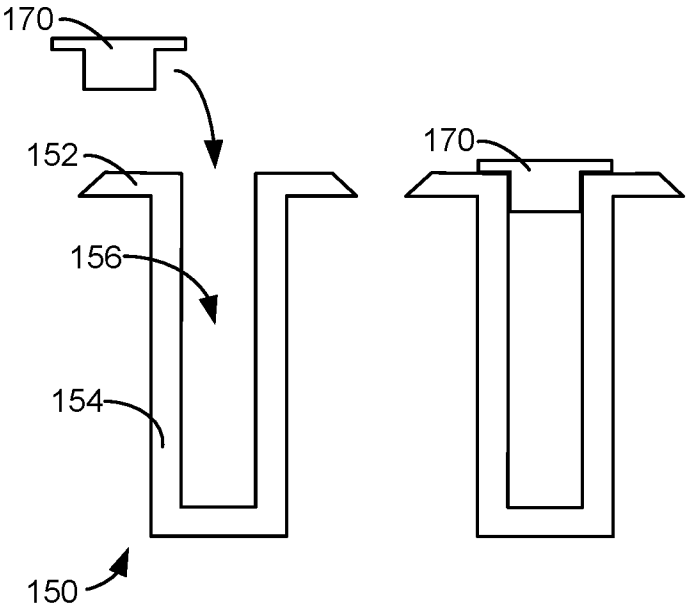
FIG. 15 shows that the opening in the receptacle can be covered by a cap.

FIG. 15 shows that the system 90 can include a cap 170 which a user can use to cover the opening 156 in the receptacle 150 when it is not being used with the anchor 500. This is useful, as it prevents debris from falling down into the opening 156.

Figure 16:
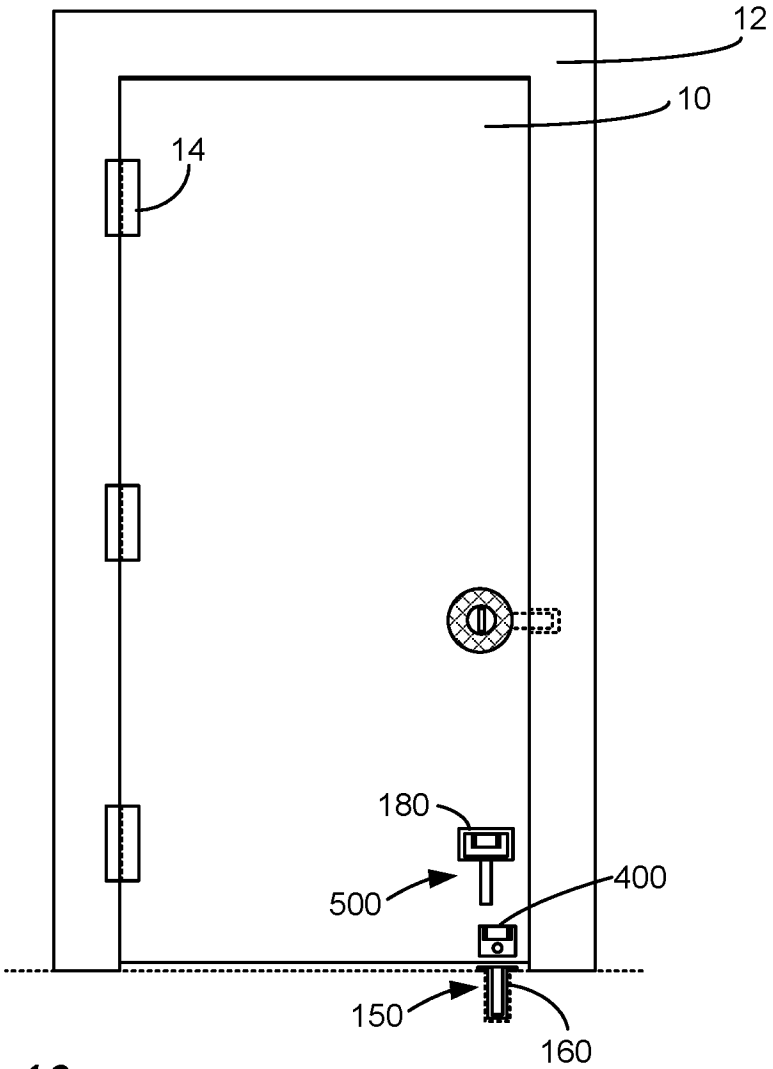
FIG. 16 shows that the system may include a hanging device to store the anchor when not in use.
Figure 16:
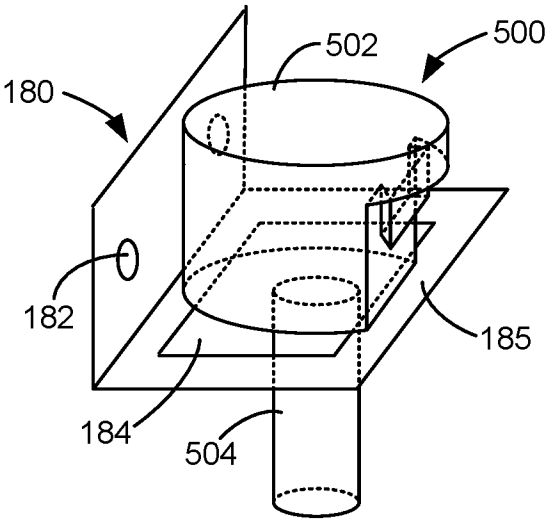

FIG. 16 shows a bracket or other hanging device 180 that can be used to hold the anchor 500 when it is not in use—i.e., when it is not placed in the receptacle 150. Such a hanging device 180 could be made in many different ways, but as shown includes support 185 with an opening 184. To store the anchor 500, the lower portion 504 can be placed though the opening 184, thus allowing the underside of the upper portion 502 to rest on the support 185. The hanging device 180 can also include screw holes 182 to allow the device 180 to be affixed to a structure. FIG. 16 shows that the hanging device 180 can be affixed to the door 10 itself, thus allowing the anchor 500 to be conveniently stored in a location proximate to the receptacle 150 and lock 400 with which it will be used.

Figure 17:
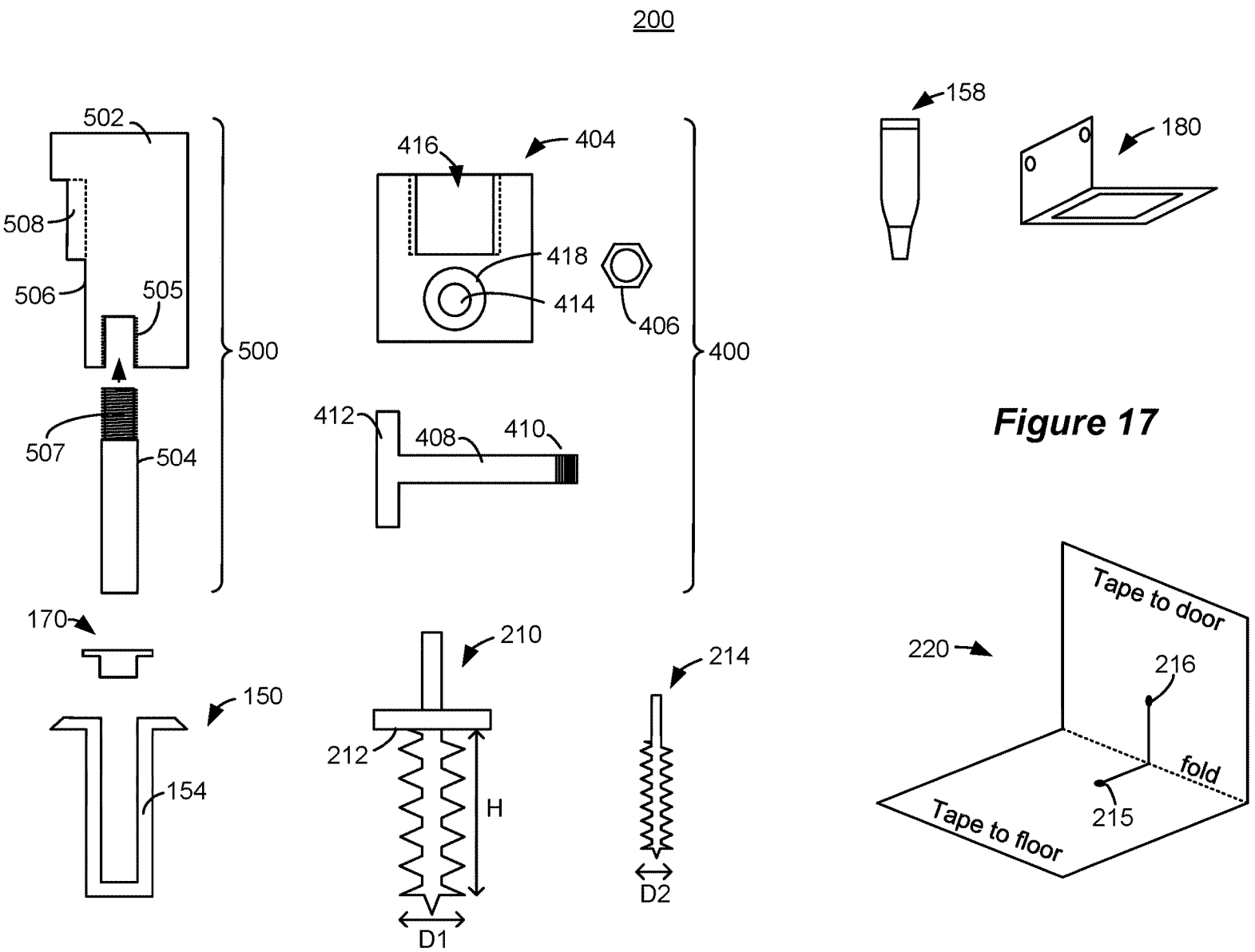
FIG. 17 shows various components that can be included in a kit to sell the system.

FIG. 17 shows components that can be included in a kit 200 that is used to sell the system 90 to consumers. The kit 200 can include the anchor 500, which in this example comprises upper and lower portions 502 and 504 as separate components. The kit 200 can also include the lock 400, including its individual components, including the key plate 404, the bolt 408 (which includes the stop 412), and the nut 406 used to affix these components to a door 10. The kit can further include the receptacle 150 and its optional cap 170, and the hanging device 180 described earlier. The kit 200 can also include items that assist the user with installation of the system 90. For example, the kit 200 can come with a drill bit 210 that is used to form the hole 160 in the floor 70 that will accommodate the receptacle 150. The drill bit 210 may be sized appropriately in diameter (D1) and height (H) to match the outer dimensions of the side wall 154 of the receptacle 150. In this regard, the drill bit 210 may include a shoulder 212 to set the height appropriately. The kit 200 may also include a tube of an adhesive or cementing material 158, which as noted earlier can be used to affix the receptacle 150 in the hole 160 in the floor 70. The kit 200 may also include a separate drill bit 214 that is used to form the opening 13 (e.g., FIG. 5A) in the door 10 as is useful to affixing the lock 400. The drill bit 214 may be sized appropriately in diameter (D2) to match the diameter of the bolt 408 that passes through opening 13 in the door 10 during the lock 400's installation.

Lastly 200 the kit may include an installation template 220 which in particular can guide the user as to where he should drill the hole 160 in the floor 70 and the opening 13 in the door. In the example shown, the template 220 comprises a sheet a paper which the user can fold (along the dotted line) and tape to the floor 70 and to the door 10 when it is shut in its frame 12. The template 220 can then instruct the user to center the drill bit 210 at a point 215, and to center drill bit 214 at point 216. The location of points 215 and 216 will depend on the dimensions of the components in the system 90, which as noted earlier can vary, but will generally be set so that vertically inserting the anchor 500 into the receptacle 150 will simultaneously allow keys 508 and 416 of the anchor 500 and lock 400 to connect.

One skilled in the art will understand that the various aspects of the system 90 can be combined in different manners to achieve different advantages. It is neither practical nor necessary to show all such possible combinations.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. Thus, the present invention is intended to cover alternatives, modifications, and equivalents that may fall within the spirit and scope of the present invention as defined by the claims.

What is claimed is:

1. A system useable to barricade a door, comprising:

an anchor comprising an upper portion and a lower portion, wherein the upper portion comprises a first vertical planar surface and a first key on the first vertical planar surface, and wherein the lower portion is configured to be insertable in an opening in a floor proximate to an inside surface of the door; and a lock affixable to the door, wherein the lock comprises a stop, a key plate, and a cross member, wherein when the lock is affixed to the door the stop is configured to be proximate to an outside surface of the door, the key plate is configured to be proximate to the inside surface of the door, and the cross member is configured to connect the stop and the key plate through an opening in the door, and wherein the key plate comprises a second key on a second vertical planar surface, wherein the upper portion is configured to engage the key plate by connection of the first and second keys when the lower portion is inserted in the opening in the floor, wherein inserting the lower portion in the opening in the floor brings the first and second vertical planar surfaces into contact, and wherein the first and second vertical planar surfaces are parallel with the door when the lower portion is inserted, wherein a bottom of the one of the first or second keys is configured to contact a bottom of the other of the first or second keys when the upper portion engages the key plate, wherein the bottoms of the first and second keys are perpendicular to the first vertical planar surface.

2. The system of claim 1, wherein the lower portion and the opening in the floor are cylindrical.

3. The system of claim 1, wherein the stop and cross member comprise an integrated piece.

4. The system of claim 1, wherein the cross member comprises a bolt, wherein the bolt is configured to connect to the key plate though an opening in the key plate.

5. The system of claim 4, wherein the bolt comprises a threaded end, and further comprising a nut, wherein the nut is configured to affix to the threaded end of the bolt to connect the bolt to the key plate.

6. The system of claim 1, wherein an inside surface of the key plate is configured to contact the inside surface of the door, and an inside surface of the stop is configured to contact the outside surface of the door, when the lock is affixed to the door.

7. The system of claim 1, wherein the lower portion is configured to be vertically inserted into the opening in the floor.

8. The system of claim 1, wherein the first key is configured to connect with the second key by vertically inserting the first key into the second key, or by vertically inserting the second key into the first key, when the lower portion is vertically inserted into the opening in the floor.

9. The system of claim 1, further comprising:

a receptacle, wherein the receptacle is configured to be positioned in a hole in the floor proximate the inside surface of the door, wherein the receptacle comprises the opening in the floor proximate to the inside surface of the door.

10. The system of claim 9, wherein an underside of the lower portion is configured to contact the receptacle when the anchor is placed in the receptacle.

11. The system of claim 1, wherein the upper portion is configured to engage the key plate when the lower portion is inserted in the opening in the floor and when the door is closed in a door frame.

12. The system of claim 1, wherein one of the first or second keys comprises a male key, and is configured to insert into a female key of the other of the first or second keys when the upper portion engages the key plate.

13. A system useable to barricade a door, comprising:

an anchor comprising an upper portion and a lower portion, wherein the upper portion comprises a first key on a first vertical planar surface, and wherein the lower portion is configured to be insertable in an opening in a floor proximate to an inside surface of the door; and a lock affixable to the door, wherein the lock comprises a stop, a key plate, and a cross member, wherein when the lock is affixed to the door the stop is configured to be outside the door, the key plate is configured to be proximate to the inside surface of the door, and the cross member is configured to connect the stop and the key plate through an opening in the door, and wherein the key plate comprises a second key on a second vertical planar surface, wherein the cross member is configured to connect to the key plate by a nut proximate to the inside surface of the door, wherein the upper portion is configured to engage the key plate by connection of the first and second keys when the lower portion is inserted in the opening in the floor, wherein the cross member has a length longer than a thickness of the door to allow the door to be opened outwardly a gap before an outside surface of the door hits the stop.

14. The system of claim 13, wherein when the upper portion engages the key plate the door is closed in a door frame and is barricaded from being opened inwardly.

15. The system of claim 13, wherein the stop and cross member comprise an integrated piece.

16. The system of claim 13, wherein the lower portion is configured to be vertically inserted into the opening in the floor.

17. The system of claim 13, wherein the first key is configured to connect with the second key by vertically inserting the first key into the second key, or by vertically inserting the second key into the first key, when the lower portion is vertically inserted into the opening in the floor.

18. The system of claim 13, further comprising:

a receptacle, wherein the receptacle is configured to be positioned in a hole in the floor proximate the inside surface of the door, wherein the receptacle comprises the opening in the floor proximate to the inside surface of the door.

* * * * *